US007402093B2

(12) United States Patent
Sjolander et al.

(10) Patent No.: US 7,402,093 B2
(45) Date of Patent: Jul. 22, 2008

(54) GRINDING APPARATUS FOR BUTTONS ON ROCK DRILL BIT

(75) Inventors: Bjorn Sjolander, Oakville (CA); Bo Thomas Sjolander, Oakville (CA); Robert Sjolander, Oakville (CA)

(73) Assignee: C.M.E. Blasting & Mining Equipment Ltd, Ontario (CA)

( * ) Notice: Subject to any disclaimer, the term of this patent is extended or adjusted under 35 U.S.C. 154(b) by 136 days.

(21) Appl. No.: 10/542,599

(22) PCT Filed: Feb. 19, 2004

(86) PCT No.: PCT/CA2004/000222

§ 371 (c)(1),
(2), (4) Date: Jul. 14, 2005

(87) PCT Pub. No.: WO2004/073923

PCT Pub. Date: Feb. 9, 2004

(65) Prior Publication Data

US 2006/0105675 A1 May 18, 2006

(30) Foreign Application Priority Data

Feb. 19, 2003 (CA) ..... 2419214

(51) Int. Cl.
*B24B 49/00* (2006.01)

(52) U.S. Cl. ..... 451/5; 451/11; 451/48; 451/342; 451/246

(58) Field of Classification Search ..... 451/5, 451/10, 11, 48, 241, 342, 280, 236, 156, 451/177, 178, 242, 246
See application file for complete search history.

(56) References Cited

U.S. PATENT DOCUMENTS

| | | | | | |
|---|---|---|---|---|---|
| 5,070,654 | A | * | 12/1991 | Manqvist et al. | 451/271 |
| 5,182,971 | A | * | 2/1993 | Williams | 76/5.1 |
| 5,193,312 | A | * | 3/1993 | Gudmundsson et al. | 451/271 |
| 5,639,273 | A | * | 6/1997 | Sjolander et al. | 451/450 |
| 5,711,697 | A | * | 1/1998 | Taninaga et al. | 600/510 |
| 6,129,619 | A | * | 10/2000 | Bergqvist | 451/450 |
| 6,612,908 | B2 | * | 9/2003 | Hori | 451/36 |
| 2004/0014406 | A1 | * | 1/2004 | Sjolander et al. | 451/241 |
| 2005/0107021 | A1 | * | 5/2005 | Sjolander et al. | 451/548 |
| 2007/0004320 | A1 | * | 1/2007 | Lindgren | 451/11 |

FOREIGN PATENT DOCUMENTS

CA 2313685 * 7/2000

* cited by examiner

*Primary Examiner*—Eileen P. Morgan
(74) *Attorney, Agent, or Firm*—Rolf Fasth; Fasth Law Offices

(57) ABSTRACT

The present invention relates to grinding apparatus for grinding the hard metal inserts of rock drill bits, said grinding apparatus having a grinding machine carried on an support system that provides a feed pressure for said grinding machine during grinding, said grinding machine equipped with a grinding pin driven by motor to rotate about its longitudinal axis wherein the grinding cup is rotated at variable speeds and the support system provides a variable feed pressure.

44 Claims, 20 Drawing Sheets

GRINDING APPARATUS FOR BUTTONS ON ROCK DRILL BIT

PRIOR APPLICATION

This application is a U.S. national phase application based on International Application No. PCT/CA2004/000222, filed 19 Feb. 2004, claiming priority from Canadian Patent Application No. 2,419,214, filed 19 Feb. 2003.

FIELD OF THE INVENTION

The present invention relates to improvements in apparatus for grinding the hard metal inserts or working tips of rock drill bits (percussive or rotary), tunnel boring machine cutters (TBM) and raised bore machine cutters (RBM) and more specifically, but not exclusively, for grinding the cutting teeth or buttons of a rock drill bit or cutter.

BACKGROUND OF THE INVENTION

In drilling operations the cutting teeth (buttons) on the drill bits or cutters become flattened (worn) after continued use. Regular maintenance of the drill bit or cutter by regrinding (sharpening) the buttons to restore them to substantially their original profile enhances the bit/cutter life, speeds up drilling and reduces drilling costs. Regrinding should be undertaken when the wear of the buttons is optimally one third to a maximum of one-half the button diameter.

Manufacturers have developed a range of different manual and semi-automatic grinding machines including hand held grinders, single arm and double arm self centering grinding machines and grinders designed specifically for mounting on drill rigs, service vehicles or set up in the shop. The present invention is particularly applicable to mobile grinding apparatus of the type described in U.S. Pat. No. 5,193,312 and semi-automatic grinding machines as described in U.S. Pat. No. 5,070,654 and in International Application published under WO 02/04169.

These types of machines utilize a grinding machine having a spindle or rotor rotated at high speed, typically about 12,000 to 22,000 RPM. A grinding cup mounted on the end of the rotor or spindle grinds the button and typically the face of the bit/cutter surrounding the base of the button to restore the button to substantially its original profile for effective drilling. In addition to the rotation of the grinding cup, these types of grinding machines may include features where the grinding machine is mounted at an angle to the longitudinal axis of the button and the grinding machine is rotated to provide orbital motion with the center of rotation lying in the center of the grinding cup. When grinding the buttons, the centering aspects of the grinding machine tend to center the grinding machine over the highest point on the button. On buttons where wear is uneven, typically gauge buttons, this may result in regrinding the button off center from its longitudinal axis.

The conventional grinding machines switch between grinding pressure and balance pressure to achieve the desired effect. This, for example, does not allow for a grinding pressure equal to zero. In conventional grinding machines, the minimum grinding pressure is equivalent to the weight of the arm or lever section and the components attached to it.

Longstanding problems with these types of grinding machines are vibration and noise due to high rotational speeds, wear, the requirement for large compressors for pneumatic systems and long grinding times per button, in the larger sizes of six minutes or more.

SUMMARY OF THE INVENTION

It is an object of the present invention to provide grinding apparatus having a grinding machine for rotation of a grinding cup, bit holding means and a support system where the grinding cup is rotated by said grinding machine at controlled variable speeds, preferably from about 2200 to 6000 RPM, and the support system is capable of providing controlled variable feed pressure, preferably or optionally up to 350 kilos. The speed of rotation of the grinding cup and feed pressure may optionally be varied during a grinding cycle of a working tip on a rock drill bit.

It is a further object of the present invention to provide grinding apparatus with a grinding machine that utilizes an electric motor capable of producing high torque over a range of RPMs, with a relatively compact size and weight.

It is a further object of the present invention to provide grinding apparatus having a water-cooled motor optionally using the same coolant that is used during grinding by the grinding cup.

It is a further object of the present invention to provide grinding apparatus having a frequency inverter to optimize the power and/or torque to size ratio in a grinding machine, and to add the flexibility to change the motor performance characteristics as deemed appropriate for optimized grinder performance.

It is a further object of the present invention to provide grinding apparatus having an electronic programmable control system capable of controlling, monitoring and adjusting all or select operational parameters.

Accordingly the present invention provides a grinding apparatus for grinding the hard metal inserts of rock drill bits. The hard metal inserts can be on percussive or rotary drill bits, tunnel boring machine cutters or raised bore machine cutters. The grinding apparatus has a grinding machine, bit holding means and a support system. The support system provides a feed pressure for the grinding machine during grinding. The grinding machine is equipped with a grinding cup driven by a motor to rotate the grinding cup about its longitudinal axis at controlled variable speeds, preferably from about 2200 to 6000 RPM. The support system provides a controlled variable feed pressure preferably up to 350 kilos. In one embodiment the support system includes means to limit the distance of travel and/or to limit speed of travel of the grinding machine during grinding.

Another aspect of the present invention relates to the grinding machine utilizing an electric motor capable of producing high torque over a range of speeds preferably from about 2200 to 6000 RPM, with a relatively compact size and weight. To further optimize the power and/or torque to size ratio, and to add the flexibility to change the motor performance characteristics as deemed appropriate the present invention preferably utilizes a frequency inverter. The electric motor is preferably water-cooled and optionally uses the same coolant that is used during grinding by the grinding cup.

A further aspect of the present invention relates to grinding apparatus having a control system optionally but preferably including interconnected control modules including an operator input panel and an optionally attached programmable control card module and/or a separate tilt/laser control card module, all of which are connected to a suitably located multi-function input/output card module that acts as a central communications hub for the all the various modules that are part of the control system which as whole is capable of monitoring and adjusting all components and/or sub-systems connected to the control system, including one or more operational parameters selected from the group consisting of feed pressure, grinding cup RPM and grinding time. In another embodiment the programmable control system is capable of monitoring and adjusting one or more additional operational parameters selected from the group consisting of coolant flow to the surface of the hard metal insert, coolant flow to the electric motor, output frequency and/or voltage from the frequency inverter, biased side load, counter balancing pressure, bit positioning, power indexing of bits, angle of the grinding machine, speed of the rotation motor, tilting of the table or other support holding the bit, etc.

The benefit of the electronic programmable control system and its various built in capabilities is that the range of RPMs for example is upgradable and/or adjustable to meed future demands. For example, with the configuration of the present invention it would be rpossible to change the overall range of RPMs to 1000 to 11000 RPMs if for example a new grinding cup matrix and/or new overall configuration were developed. Another potential reason that the operating characteristics may need to be modified would be if the material in the button being ground changed. Due to the inherent flexibility of the overall control system and components/modules connected to it the ability for the grinding apparatus to meet future demands is maximized.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying photographs, in which.

DETAILED DESCRIPTION OF PREFERRED EMBODIMENTS

Figure 1:
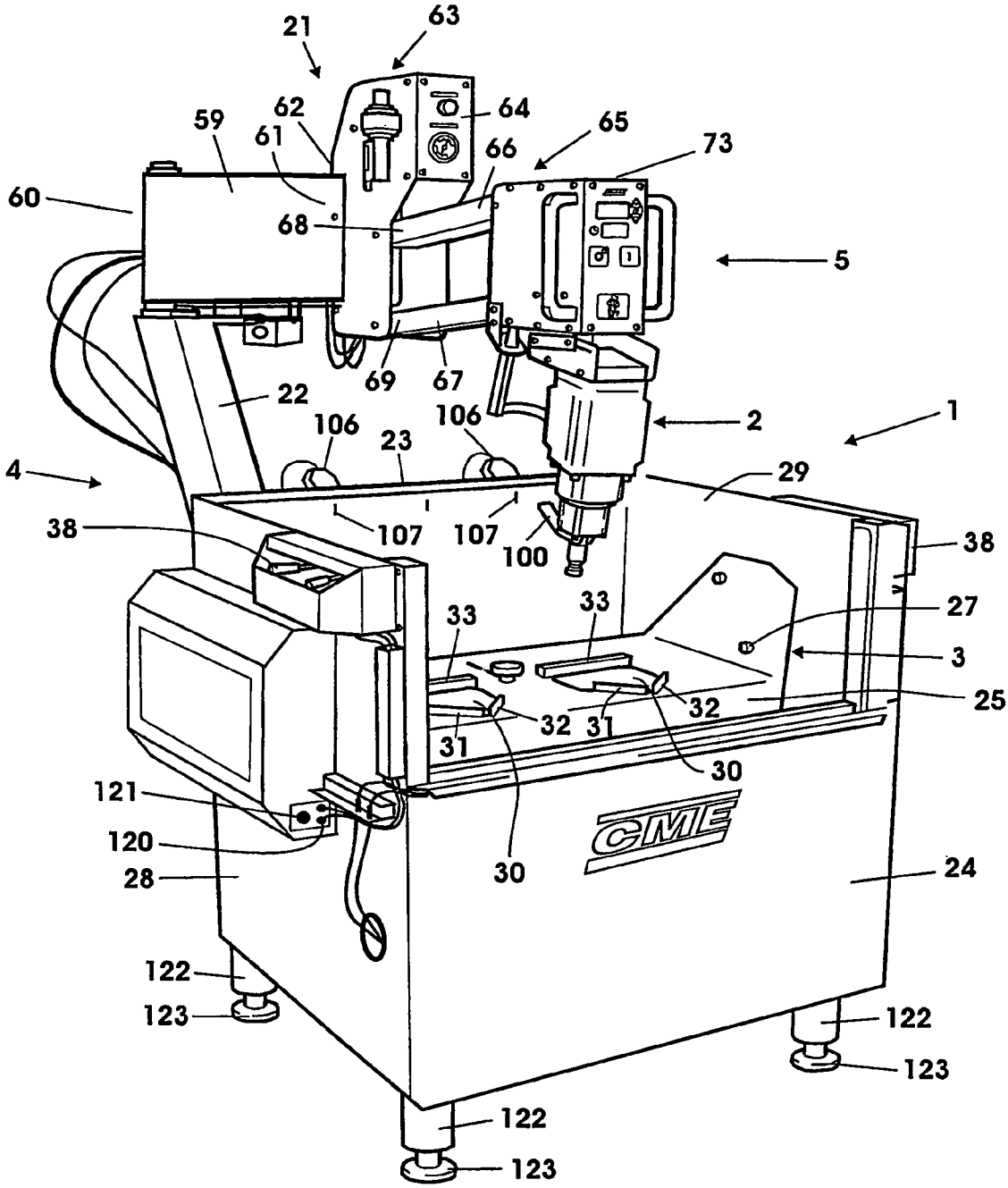
FIG. 1 is perspective view from the left side of one embodiment of a grinding apparatus according to the present invention having a grinding machine carried for vertical and horizontal adjustment by a support system, and means for holding the bit(s) to be ground.
Figure 3:
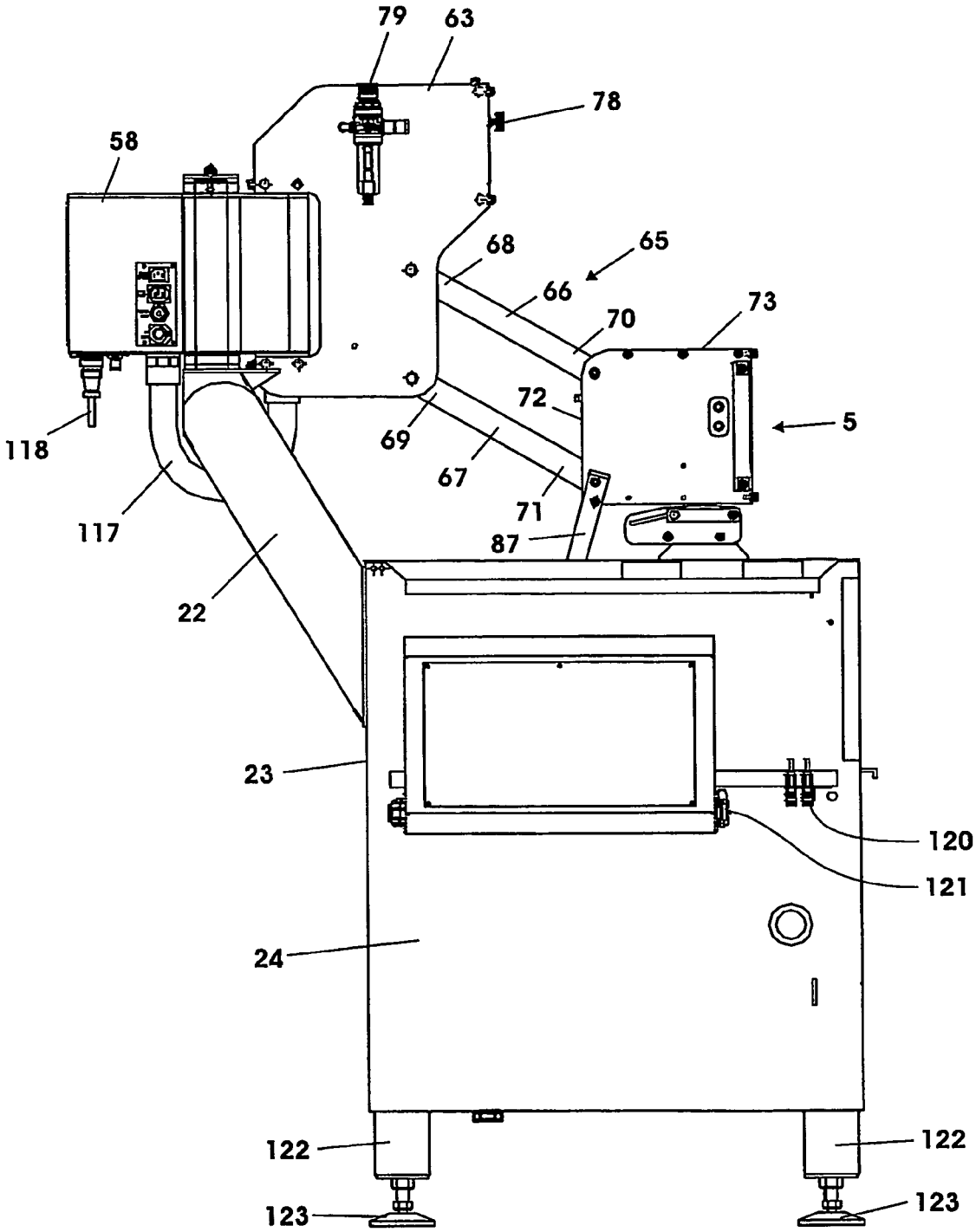
FIG. 3 is a view of the left side of the grinding apparatus of FIG. 1.
Figure 4:
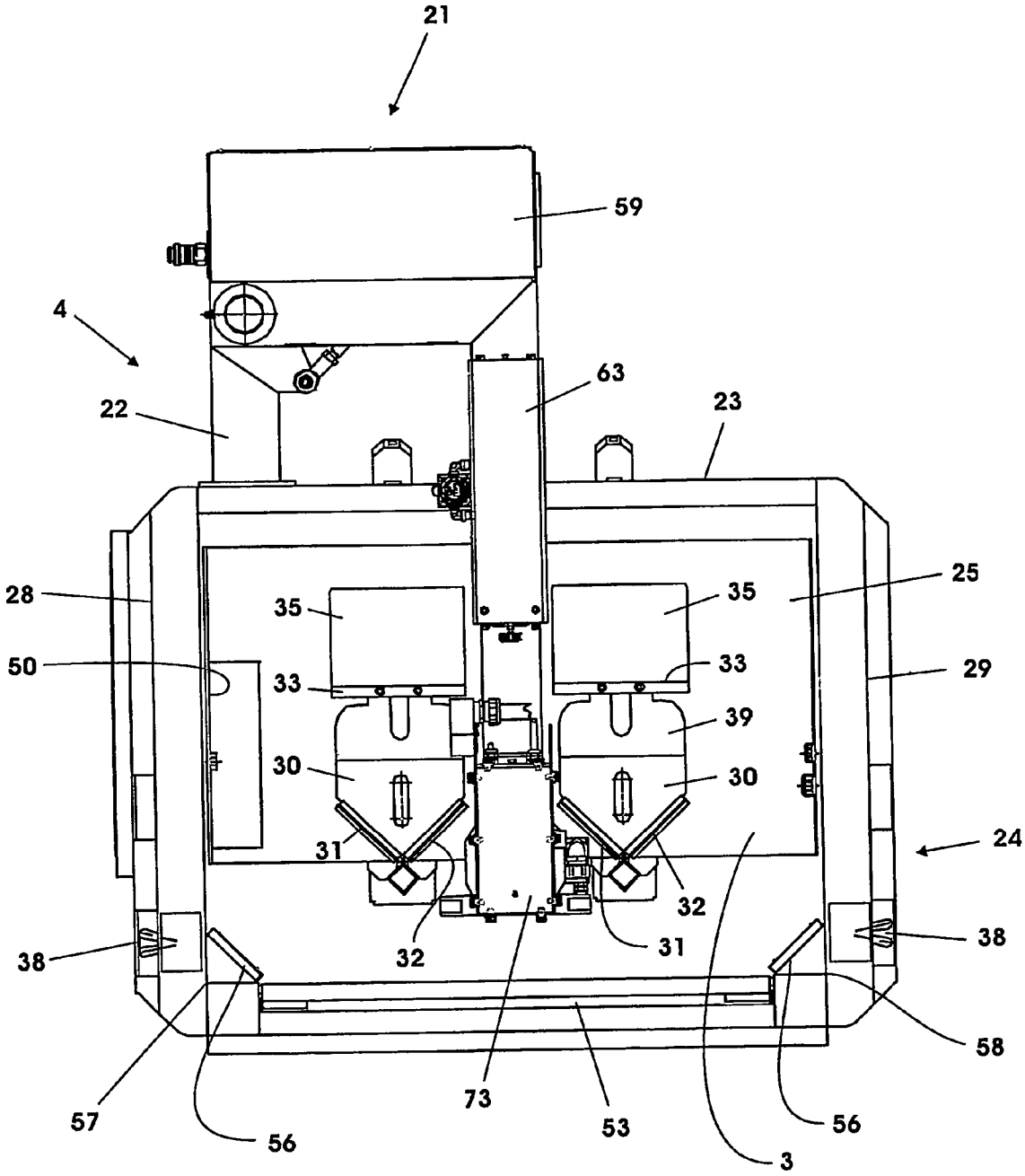
FIG. 4 is a top plan view of the grinding apparatus of FIGS. 1 and 3.

With reference to FIGS. 1, 3 and 4 one embodiment of a grinding apparatus according to the present invention is generally indicated at 1. The grinding apparatus 1 includes a grinding machine 2, means for holding one or more bits to be ground generally indicated at 3 and a support system generally indicated at 4. The grinding machine 2, means for holding the bits 3 and support system 4 are arranged to permit relative movement been the grinding machine 2 and the bit to be ground to permit alignment of the grinding machine 2 with the longitudinal axis of the buttons on the bit. The grinding apparatus 1 preferably has a control system having a programmable operator control panel 5 capable of monitoring and adjusting one or more operational parameters. The operational parameters of most interest are selected from the group consisting of feed pressure, grinding cup RPM and grinding time. The control system is preferably capable of monitoring and adjusting one or more additional operational parameters selected from the group consisting of coolant flow to the surface of the hard metal insert, coolant flow to the electric motor, output frequency and/or voltage from the frequency inverter, biased side load, counter balancing pressure, bit positioning, power indexing of bits, angle of the grinding machine, speed of the rotation motor, tilting of the table or other support holding the bit, etc.

Figure 2:
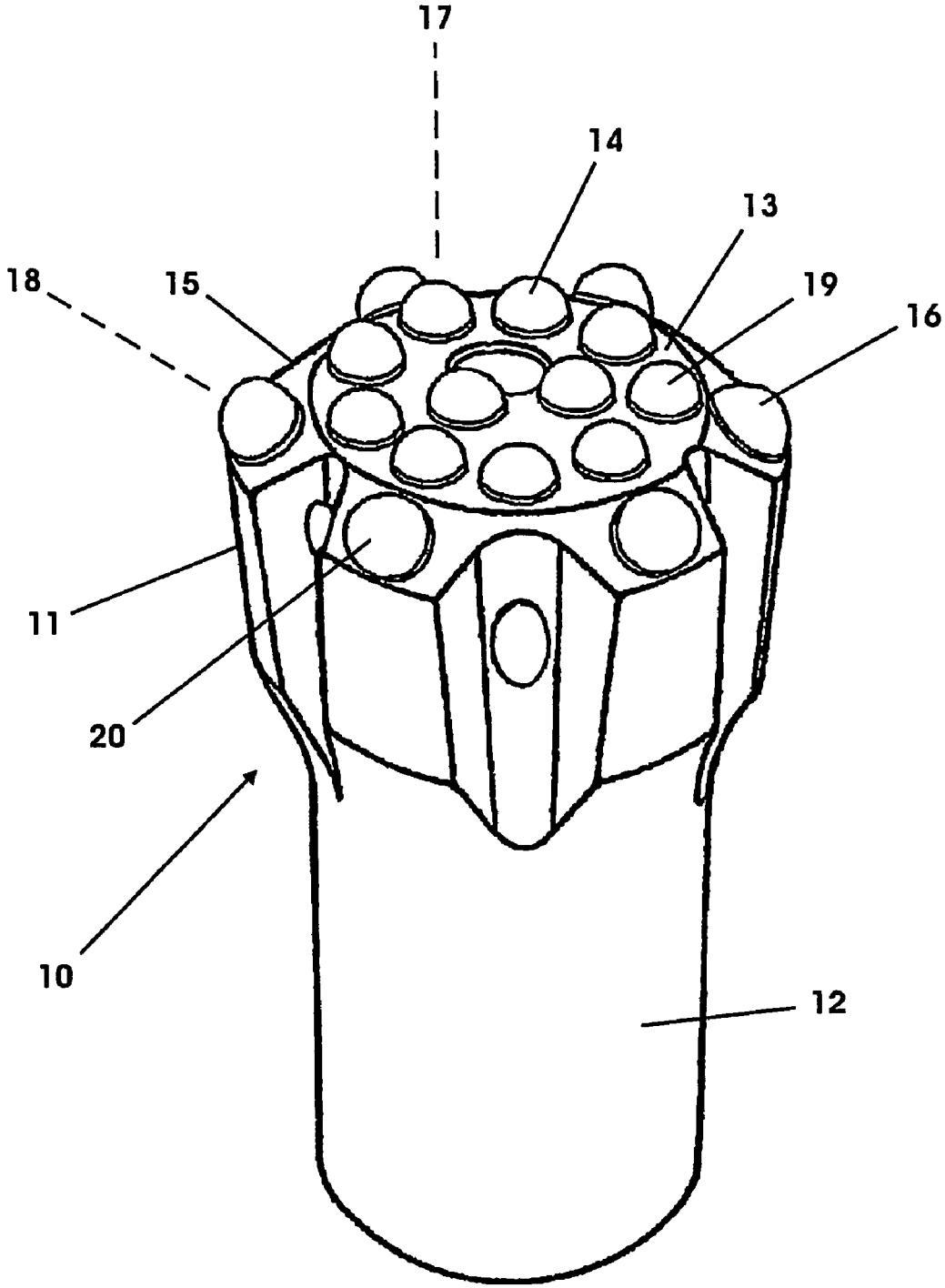
FIG. 2 is perspective view of a percussive drill bit.

FIG. 2 illustrates a percussive rock drill bit 10. The bit 10 has a head portion 11, and a shank 12. The head portion 11 has a front face 13 and a peripheral edge 15. A series of buttons 14 are assembled on the front face 13. Around the peripheral edge (gauge) are a series of gauge buttons 16. The buttons 14,16 are typically formed as a cylinder from wear resistant hard metals such as tungsten carbide. The buttons 14 are, in this example, mounted with their longitudinal axis 17 perpendicular to the front face 13 of bit 10. The peripheral edge 15 is beveled and gauge buttons 16 are mounted with their longitudinal axis 18 at an angle. The working tip 19, 20 of buttons 14,16 is typically provided with a semi-spherical, hemispherical, conical, semi-ballistic or ballistic profile and have a diameter from 6 mm to 26 mm or more depending on the size of the bit 10. As noted above, the buttons become flattened after continued use. Regular maintenance of the drill bit or cutter by regrinding the buttons to restore them to substantially their original profile enhances the bit/cutter life, speeds up drilling and reduces drilling costs.

In the embodiment of the grinding apparatus 1 shown in FIGS. 1, 3 and 4 the grinding machine 2 is carried by support system 4 which includes an arm or lever system 21 journaled on a stand 22 attached to the rear 23 of an open box 24. The bit holder means 3 consists of a table 25 mounted within the box 24.

Figure 8:
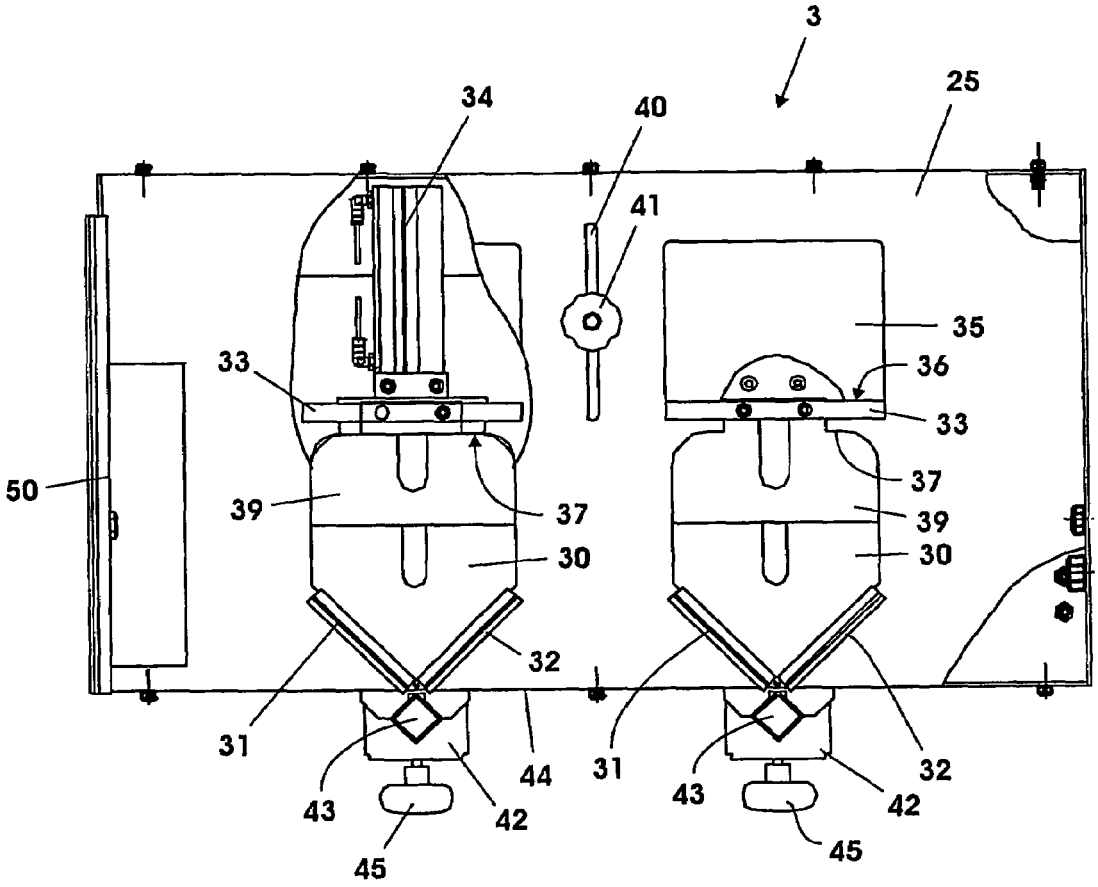
FIG. 8 is a top plan view in partial section of the table for holding the bits for pivotally mounting in the box of FIGS. 5 and 6.

In order to minimize operator set up and movement of a bit during grinding, means for holding the bits 3 is a table 25 (as shown in FIGS. 4 and 8) preferably mounted within the box 24 at pivot points 26, 27 on each side 28, 29 of the box 24 (see FIGS. 1,3 and 4) to permit the table 25 to be tilted. The bit holder means 3, in this case table 25, is provided with one or more apertures 30 to hold one or more bits to be ground. In the embodiment illustrated table 25 has two apertures 30. When a bit(s) is positioned in an aperture 30 the shank 12 of bit 10 is placed against the front edges 31,32 of aperture 30. The front edges 31,32 are preferably rubber coated. The bit is held in place against front edges 31,32 by pressure plate 33 controlled by a locking cylinder 34. A shield 35 is attached to and moves with the pressure plate 33 and fully covers the opening between the rear 36 of pressure plate 33 and back 37 of the aperture 30. The shield 35 protects the piston rod of the cylinder 34 and prevents accidental pinching of fingers, etc. when the pressure plate 33 is retracted. The locking cylinder 34 can be depressurized and backed off slightly to rotate the bit (to the next button to be ground) within the aperture 30 without full retraction of the locking cylinder 34 and pressure plate 33 attached to it. The controls 38 for operating the locking cylinder 34 are provided on the sides 28, 29 of box 24. While the method of holding a bit in the bit holder means is shown as a pressure plate 33 and locking cylinder 34 other arrangements are possible and the present invention is not limited to the embodiment is illustrated.

Large down-the-hole bits to be reground typically have a relatively long shank that fits through the aperture 30. In order to regrind smaller bits a floor plate 39 that can be slid in and out of position under the aperture 30 is provided. A knob 41 and slot 40 in the table 25 control the location of the floor plate 38. Adapters (not shown) for holding multiple small sized bits can be inserted into the aperture. Use of the adapters eliminates repetitive set up time for the operator.

Figure 9:
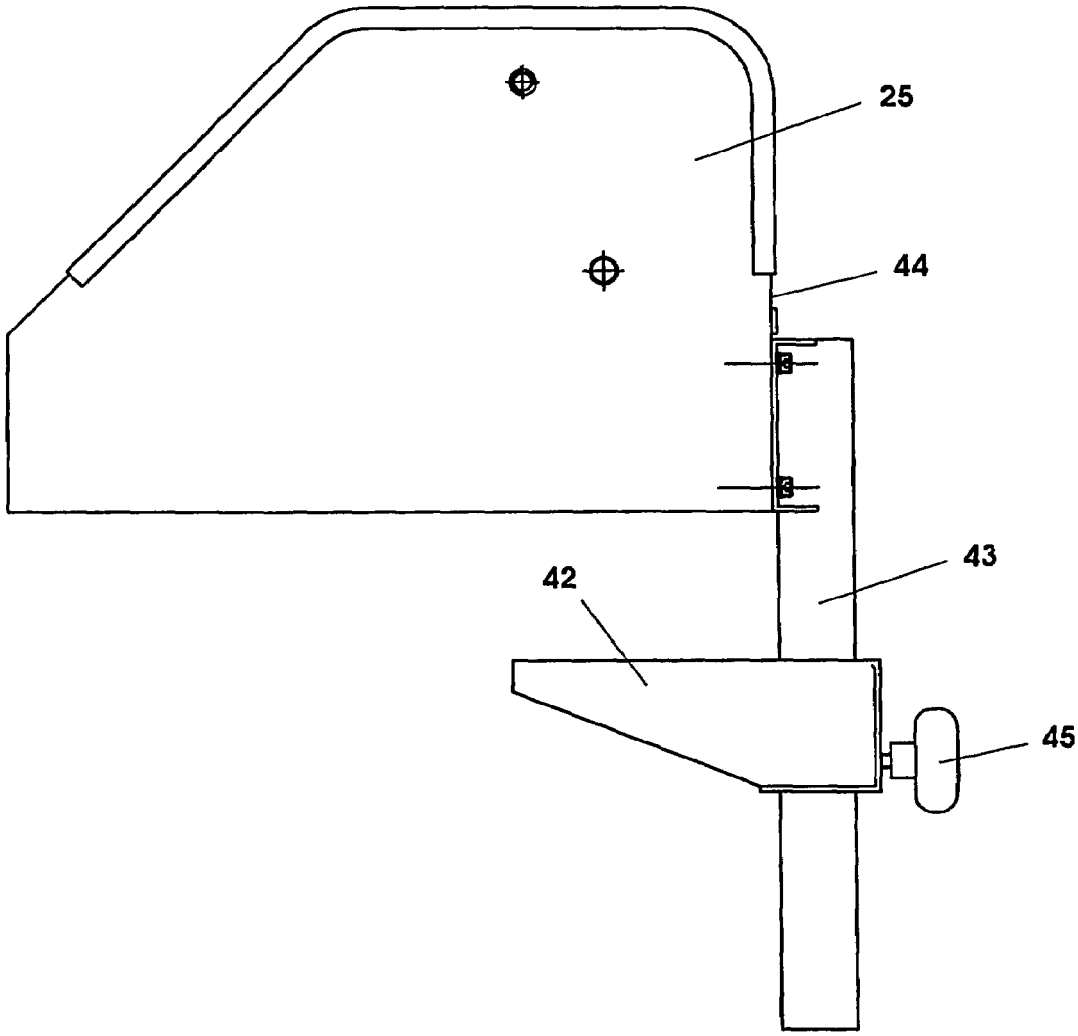
FIG. 9 is a side plan view of the support bracket assembly attached to the front of table of FIG. 8.
Figure 10:
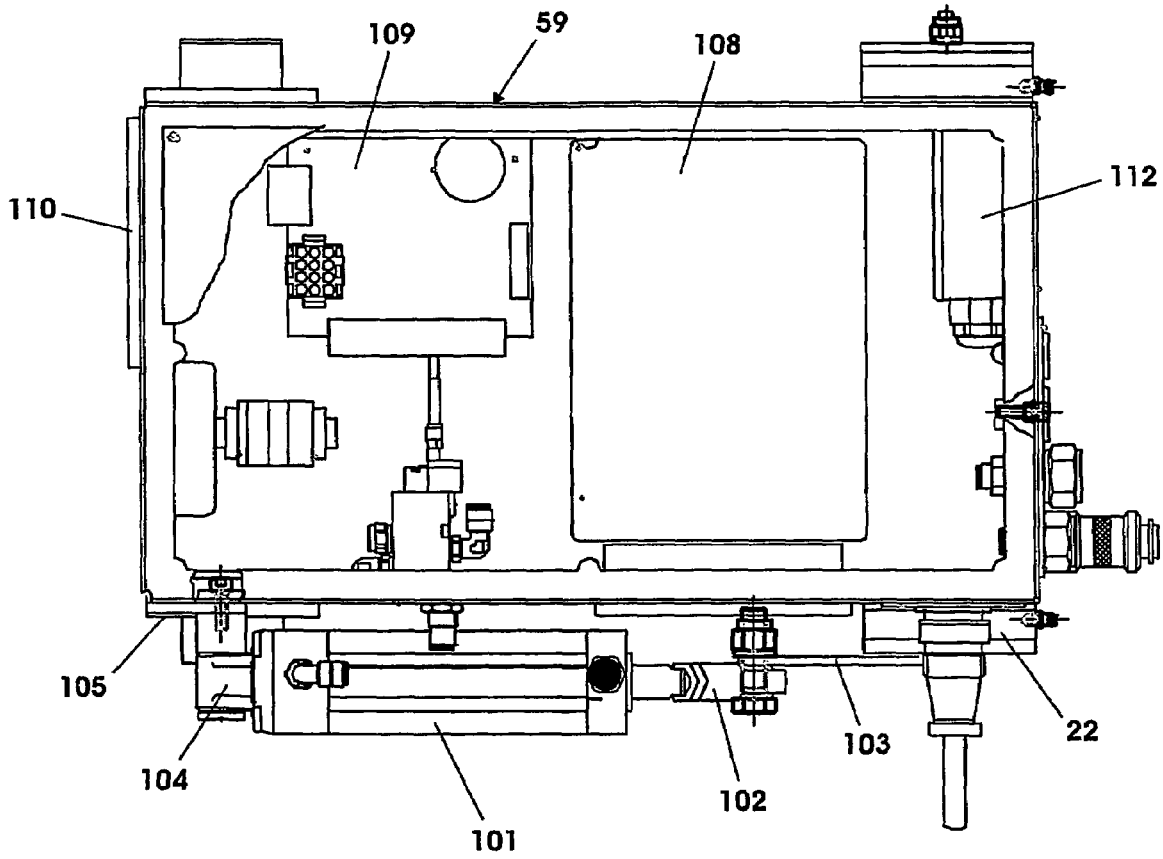
FIG. 10 is a rear view of the first arm section of the support system of FIG. 1.
Figure 11:
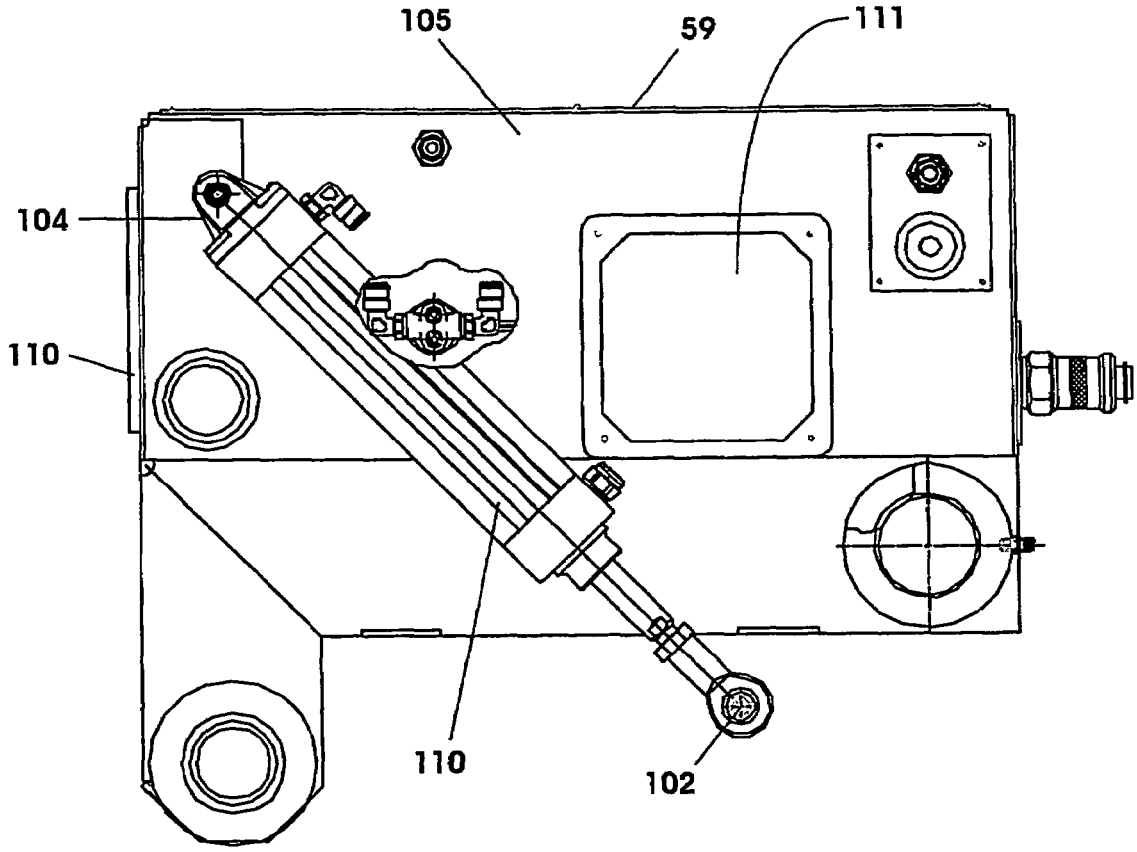
FIG. 11 is a bottom view of the first arm section of FIG. 10.

In order to facilitate set up of large bits, the grinding apparatus illustrated (see FIGS. 8 and 9) is provided with a bracket 42 on which the end of a threaded bit and/or shank of the Down the Hole bit or similar can rest. Bracket 42 slides up and down on tube 43 that is attached to the front 44 of table 25. Tube 43 is aligned with the center of aperture 30. Knob 45 is tightened to lock bracket 42 at the desired height. Table 25 can be replaced by a table (bit holder) having one aperture for holding even larger bits.

If the button to be ground is a gauge button, it is typically mounted in the bit at an angle relative to the face of the bit. The grinding machine 2, in order to properly regrind a worn button, should be aligned with the longitudinal axis of the button. Accordingly to regrind the gauge buttons, in the embodiment shown, the table 25 is tilted to correspond to the angle at which the gauge buttons are mounted in the bit. Alternatively, the grinding apparatus could have, for example, a tilting feature or positioning feature allowing the grinding machine to be aligned with the longitudinal axis of the button, without tilting the bit or button.

Figure 5:
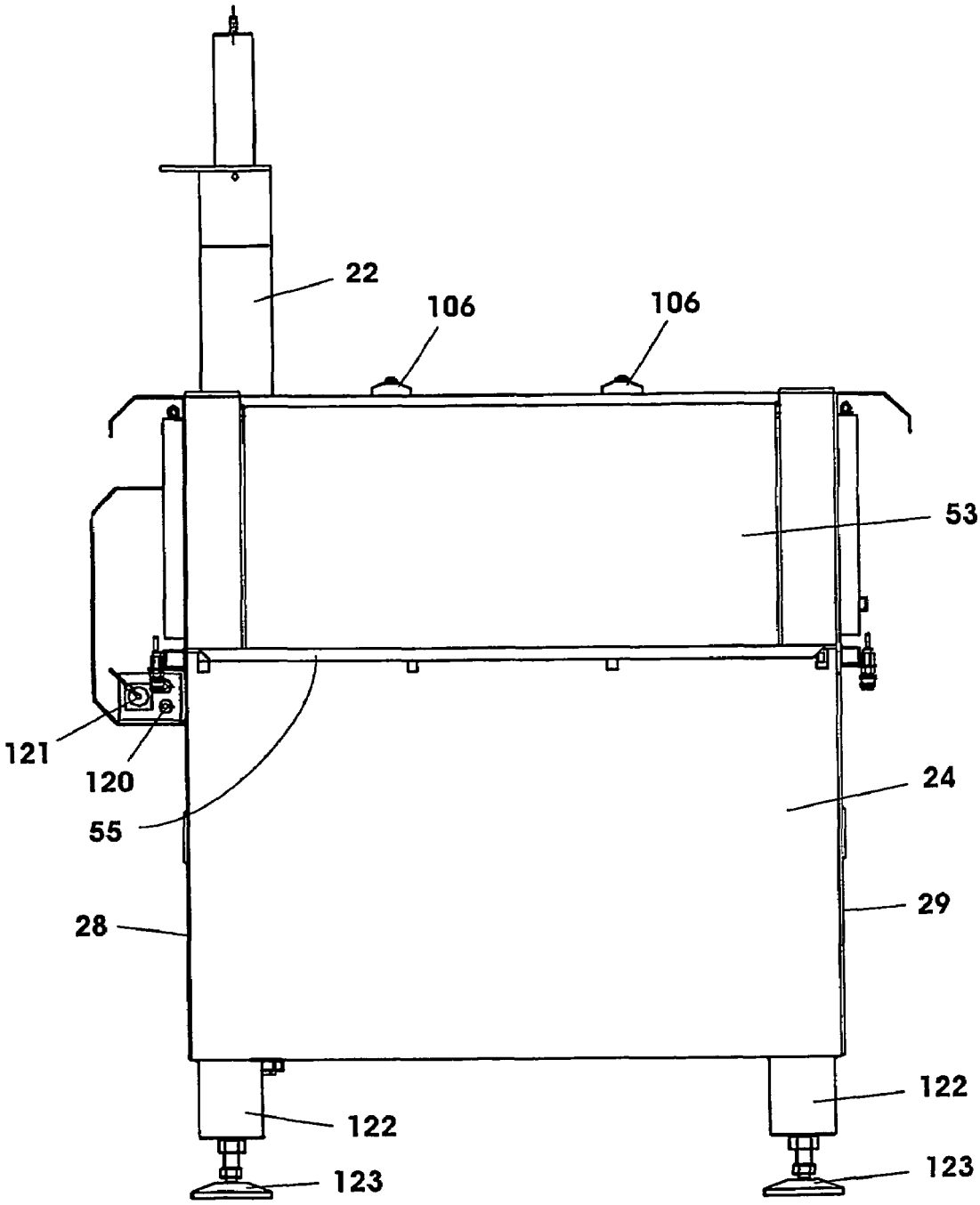
FIG. 5 is a front view of the open box and stand and that forms part of the support system of the grinding apparatus of FIG. 1.
Figure 6:
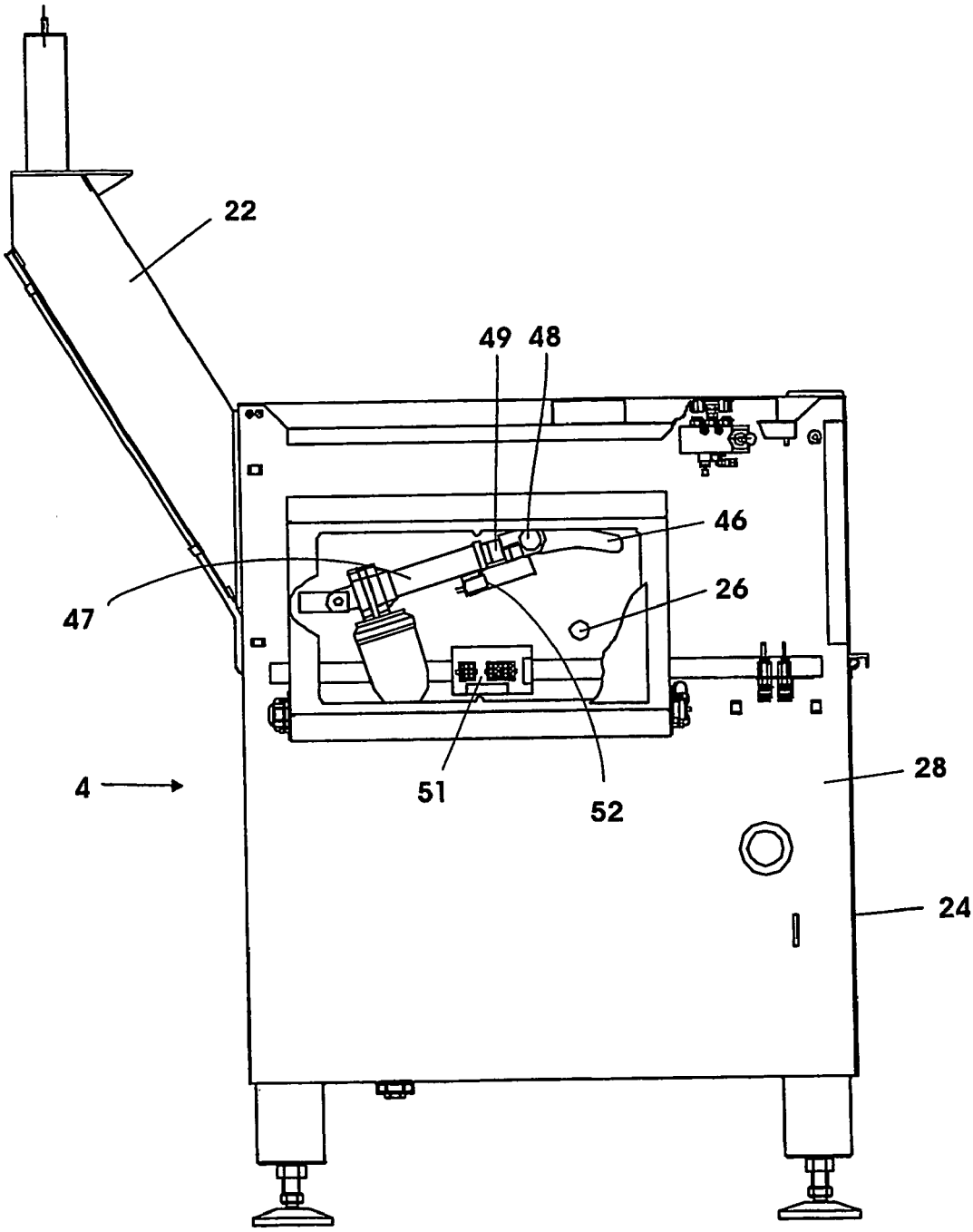
FIG. 6 is a left side view of the box and stand of FIG. 5 showing the controls for tilting the table that is pivotally mounted within the box.
Figure 7:
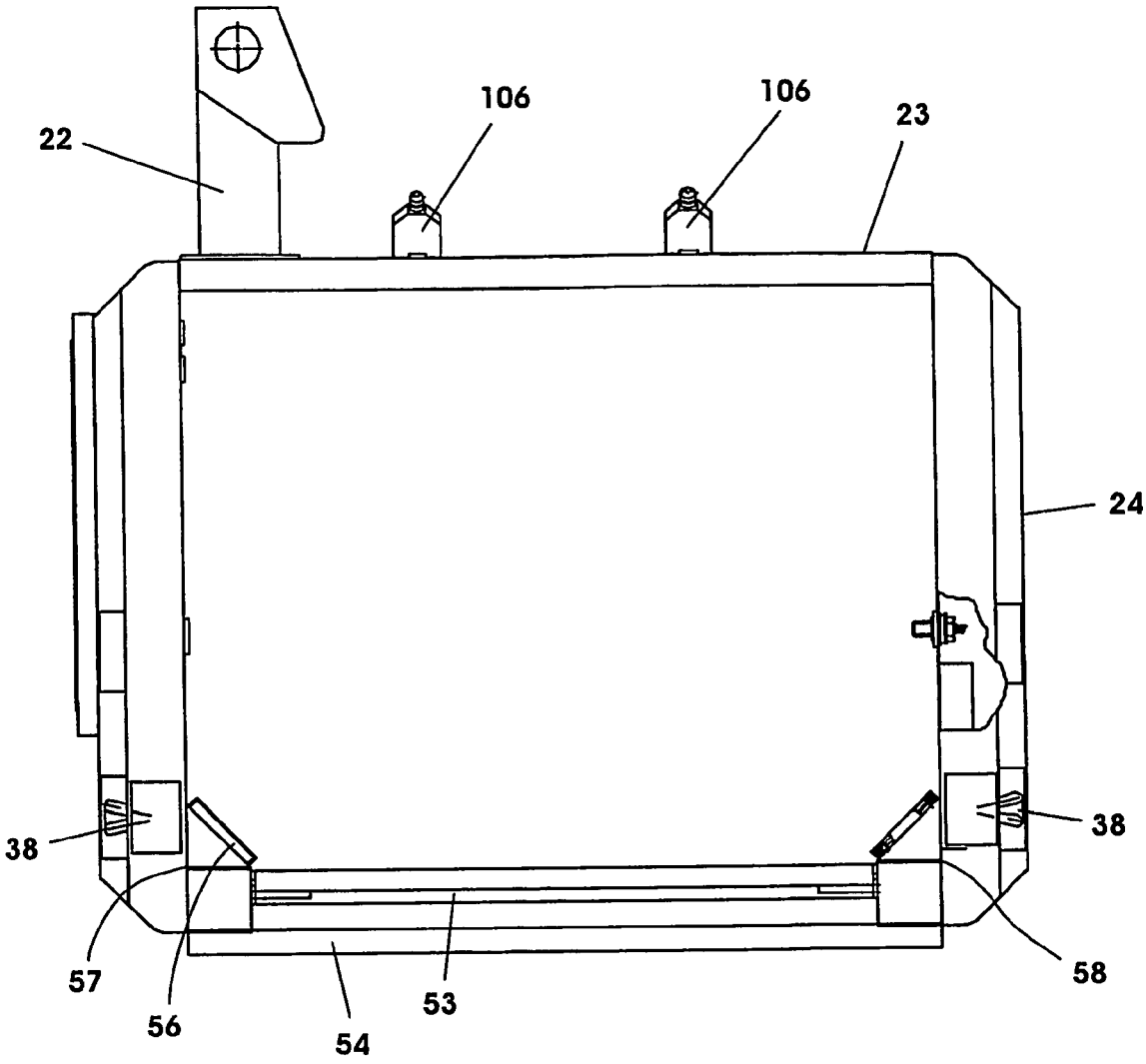
FIG. 7 is a top view of the box and stand of FIGS. 5 and 6.

The means of tilting the table 25 is best shown with reference to FIG. 6. An arced slot 46 is provided in the left side 28 of the box 24. A similar slot is provided in the right side 29 of the box 24 so the means for tilting the table can be mounted on either side of the box. A linear actuator 47 is provided on the left side 28 of the box 24 and the end 48 of the actuator rod 49 is connected to the side 50 of the table 25 through slot 46. When activated extension of the actuator rod 49 will tilt the table 25 around pivot points 26,27. The operation of the linear actuator 47 in this embodiment is controlled by the control system 5. A tilt/laser control card 51 receives input from sensor 52 on the position of the actuator rod 49 and transmit this data to the control system 5. Operation of the control system is explained in more detail later. The tilting of the table 25 can be accomplished by other means, such as hydraulic or pneumatic cylinders, gears etc or controlled manually. The tilting means can be mounted on either side of the box 24 so that two boxes may be mounted side by side, while leaving the tilting means easily accessible A splash-guard 53 is provided at the front 54 of the box 24 that can be raised and lowered along a slot on each side of the front edge 55 of the box 24 (see FIGS. 4 and 5). The splash-guard 53 can be set and retained at different heights as desired. Lights 56 are provided in the front corners 57, 58 of box 24 to provide light on the bit(s) to be ground.

In the embodiment shown, the arm or lever system 21 for carrying and positioning the grinding machine 2 as noted previously is journaled onto a stand 22 at the rear 23 of the box 24. With reference to FIGS. 10 to 15, the arm system 21 consists of a first arm section 59 having one end 60 journaled to the stand 22. The other end 61 of the first arm section 59 is journaled to the backside 62 of a first box section 63. The first arm section 59, in this embodiment, controls the horizontal location of the grinding machine 2 relative to the bit to be reground. To the front side 64 of the first box section 63 is pivotally mounted a second arm section 65. The second arm section 65 consists of a pair of parallel arms 66,67 with one end 68,69 of each arm 66,67 pivotally mounted to the front side 64 of the first box section 63. The other end 70,71 of each arm 66,67 is pivotally connected to the backside 72 of a second box section 73. The second arm section 65 controls the vertical movement of the grinding machine 2 up and down.

Within the first box section 63 (FIG. 13), is means to provide a balance pressure to the portion of the support system that controls the movement of the grinding machine 2 in the direction of the longitudinal axis of the button or bit when not in use and grinding pressure when in use. In the embodiment shown, the means to provide a balance pressure is a first cylinder 74 pivotally connected to an end 75 of the lower arm 67 of the second arm section 65. The end 75 of lower arm 67 extends out from the pivot point 76 at which the lower arm 67 is connected to the first box section 63. The cylinder 74 provides a balance pressure to the second arm section 65 when the grinding machine 2 is not in use.

The present invention has determined that relatively high feed forces applied during grinding, optionally combined with varying or relatively low spindle rpm's can optimize grinding of the buttons with reduced vibration, noise and grinding time. High feed forces in self-centering grinding machines could potentially cause the grinding machine 2 to fall off the button with great force. To produce the high feeds safely, a means by which to limit the travel of the feed is required. The need to limit travel may not be limited to feed but in any direction deemed necessary. In the embodiment shown, a brake or lock 77 within the bottom of cylinder 74 is activated on grinding to lock the position of the cylinder 74. Balance pressure regulator 78 is used by the operator to adjust the balance pressure when not grinding. A filter 79 for the pressure regulator and all other pneumatics is provided. A second short stroke feed cylinder 80 provides the feed pressure during grinding. The maximum stroke is about 10 mm in this embodiment. The first and second cylinders 74,80 are provided in an end to end alignment with the second cylinder 80 pivotally connected to the control box 63 at pivot point 81. When this type of combination is activated, the travel of the grinding machine 2 in the direction of feed is limited to the relatively short stroke of the feed cylinder 80 once the grinding cycle is activated. In the event that the grinding machine 2 falls off the button during a grinding cycle, the chances of any danger to the operator or damage to the grinding machine 2 etc. are minimized. To further minimize any damage to the equipment, grinding cups, bits, and to further minimize any chance of injury to operator, sensors in the above described cylinder combination would detect for example the feed cylinder reaching max stroke and immediately shut the grinding process down automatically. Similar safely systems can be incorporated into any method of achieving controlled feed.

Other potential solutions to achieve the same objective could be used including linear actuators or motorized screw or gear assemblies or any combination thereof potentially also including cylinder(s) optionally with brake(s) to provide controlled movement and/or positioning and/or safety coupled with suitable load sensors and means to adjust the loads as deemed necessary.

Figure 14:
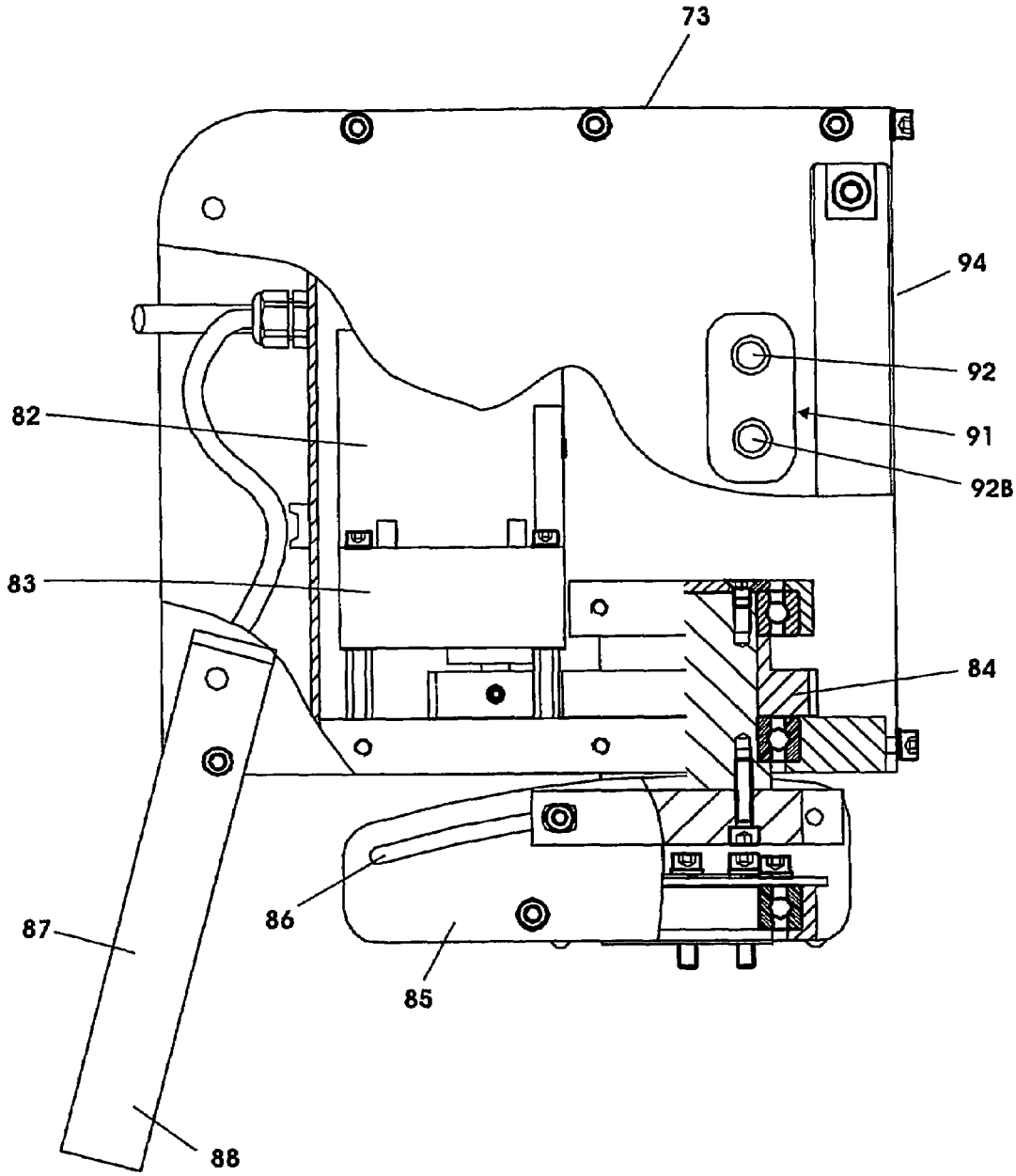
FIG. 14 is a left side view in partial cross section of the second box section for the grinding apparatus of FIG. 1.
Figure 15:
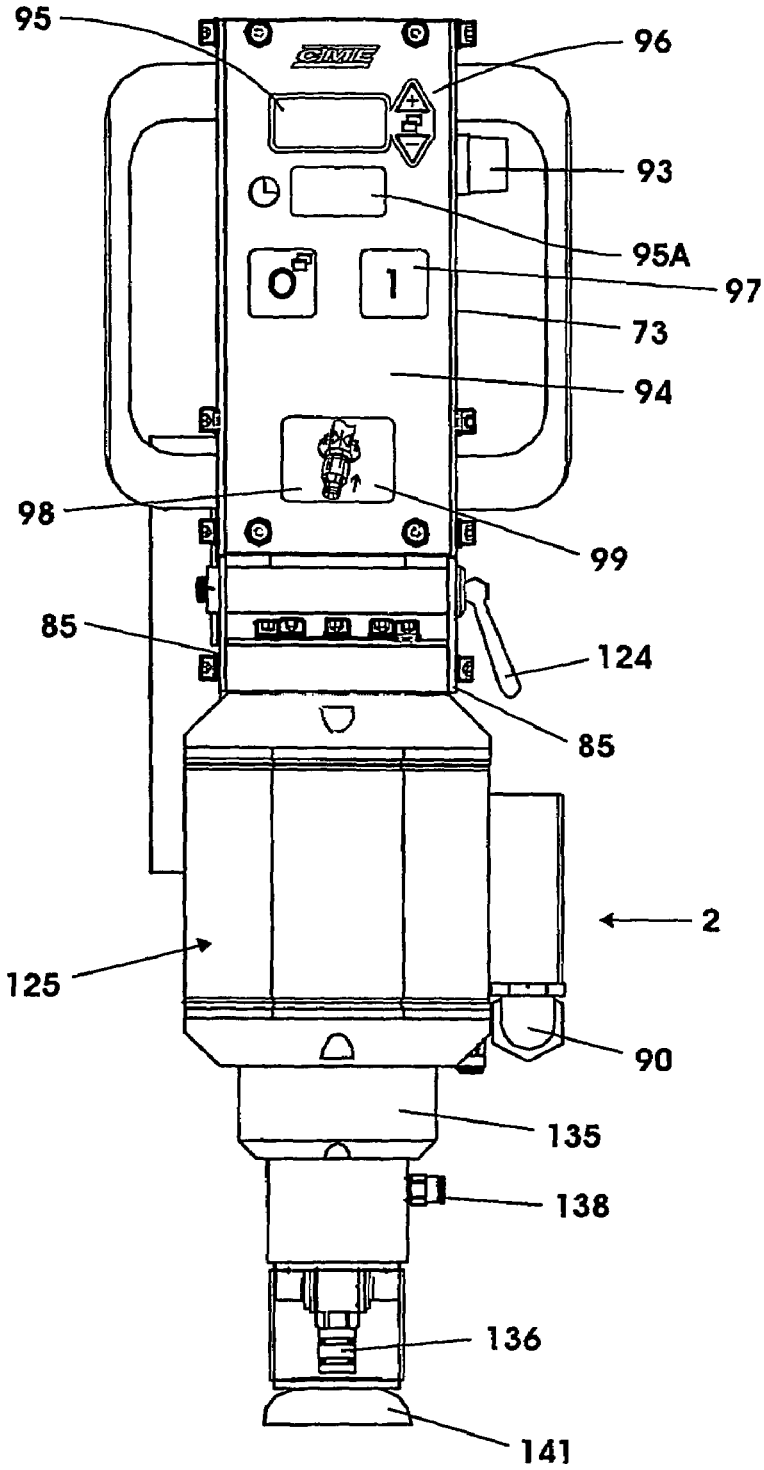
FIG. 15 is a front view of the second box section of FIG. 14 and the attached grinding machine.
Figure 16:
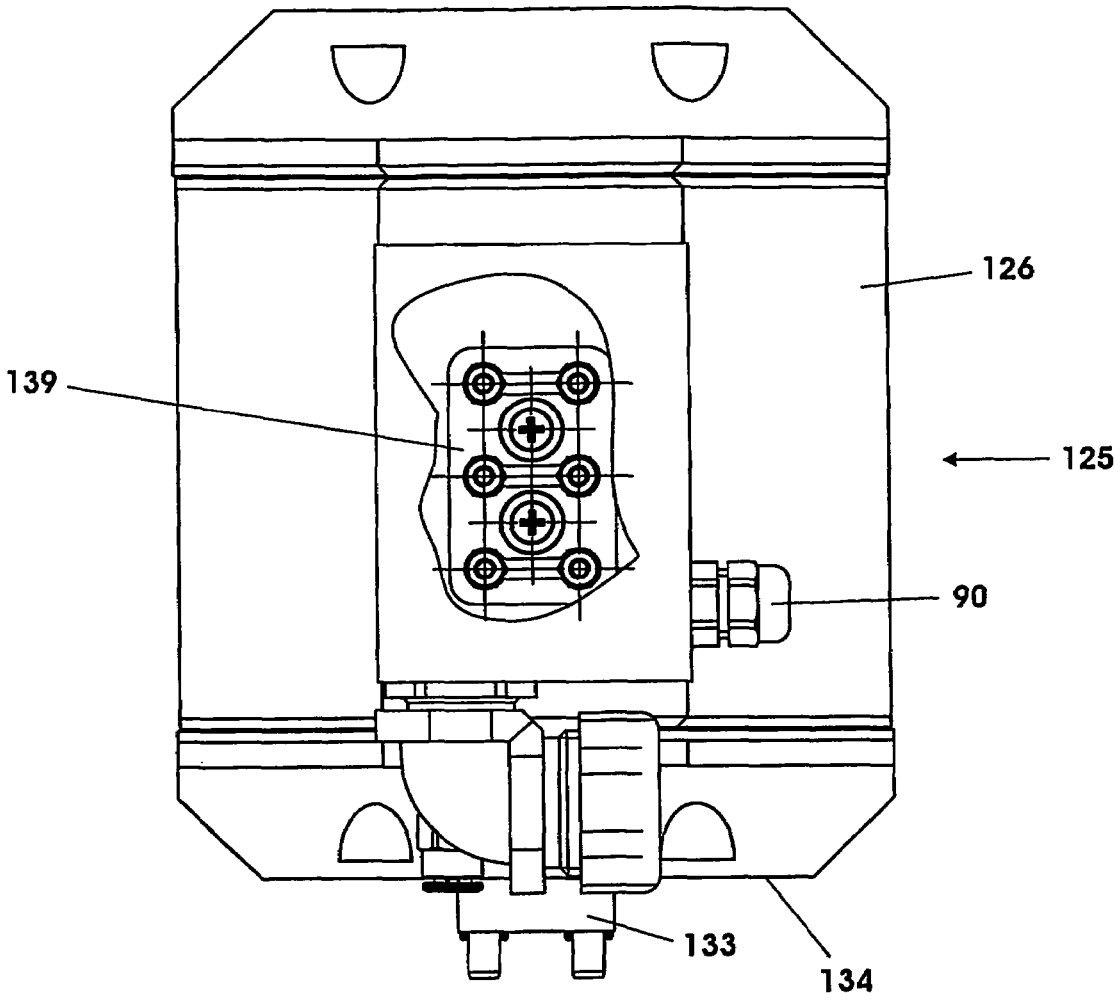
FIG. 16 is an enlarged side view partially in cross section of the motor housing for the grinding machine of FIG. 15.
Figure 17:
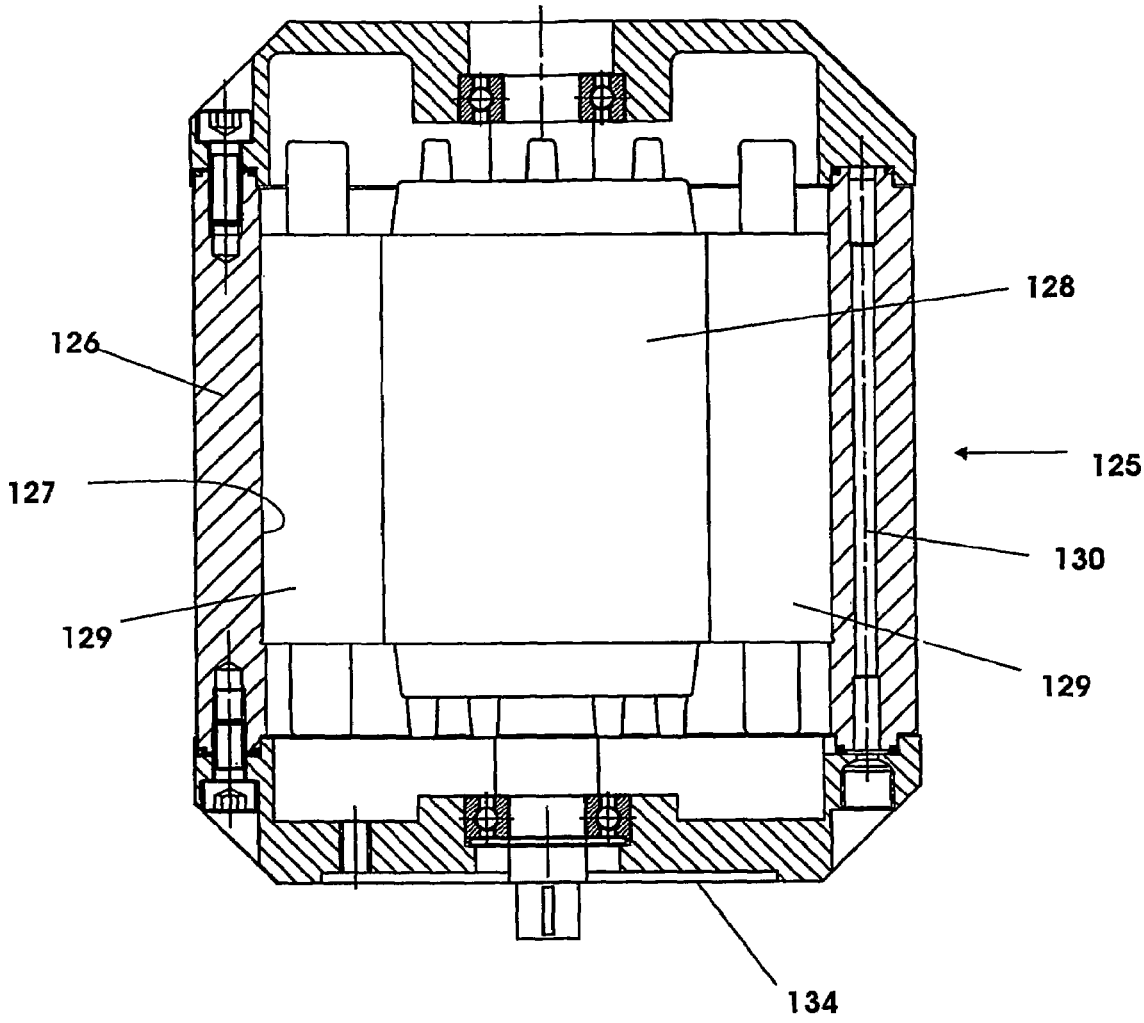
FIG. 17 is a cross section of the motor housing of FIG. 16.
Figure 18:
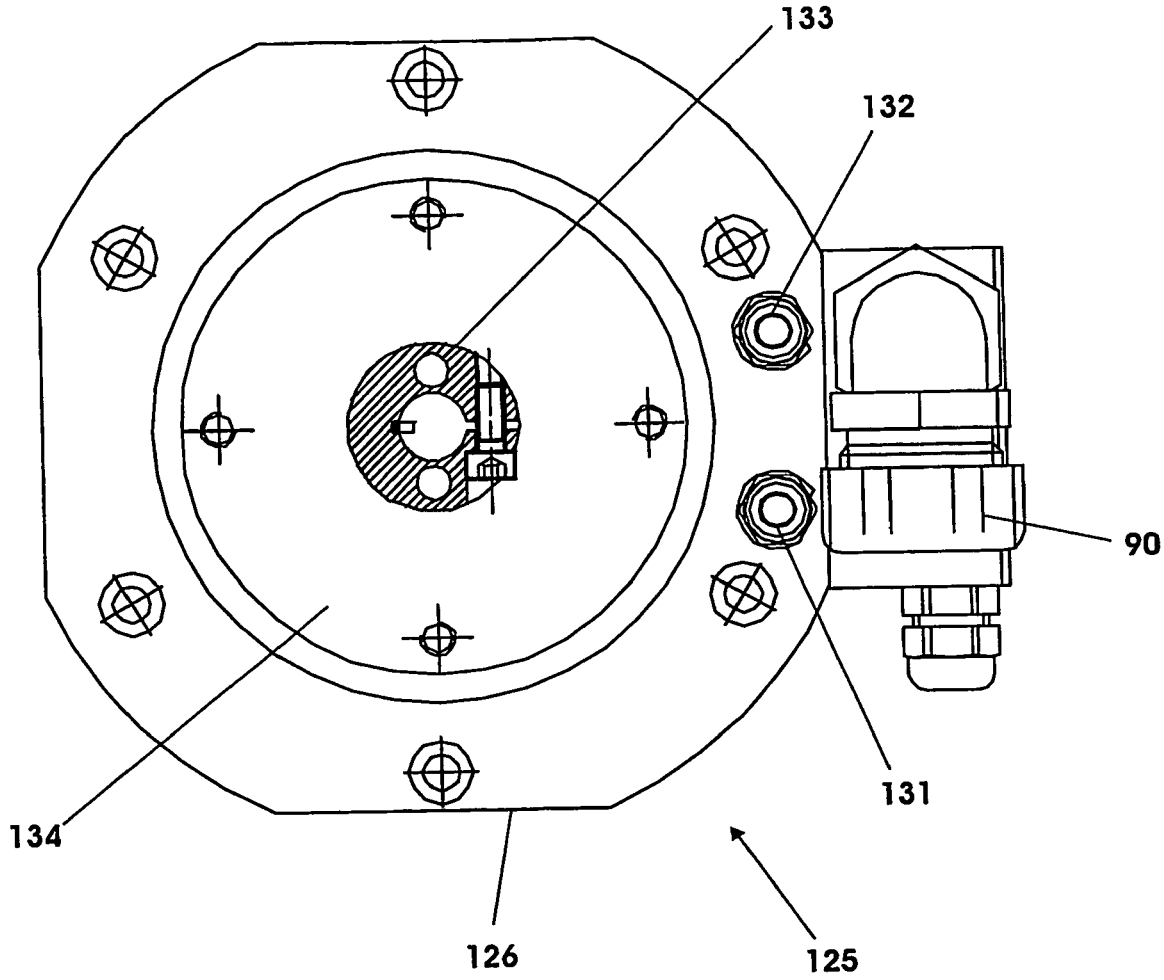
FIG. 18 is a bottom view of the motor housing of FIGS. 16 and 17.
Figure 19:
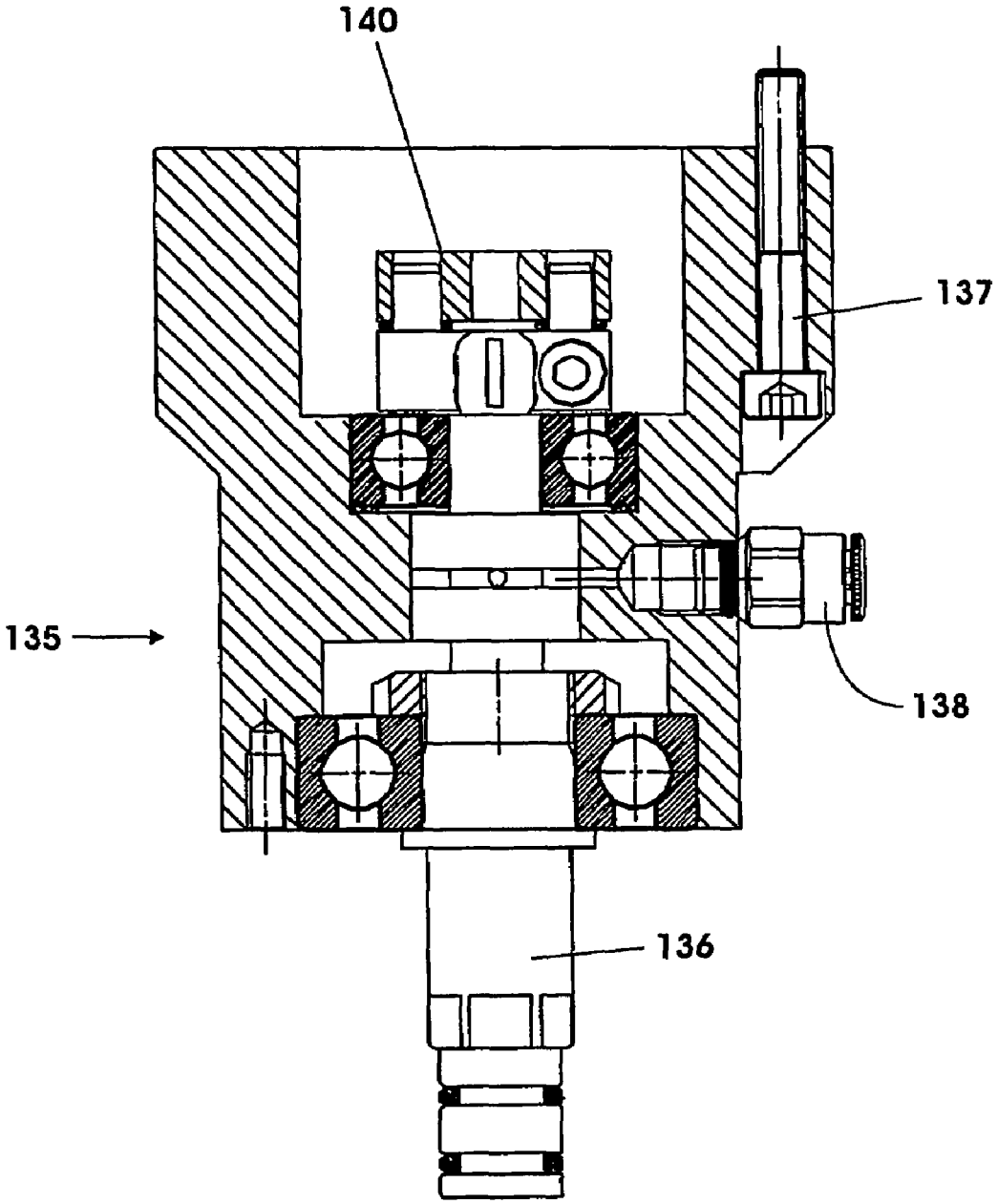
FIG. 19 is an enlarged cross section of the spindle assembly for the grinding machine of FIG. 15.
Figure 20:
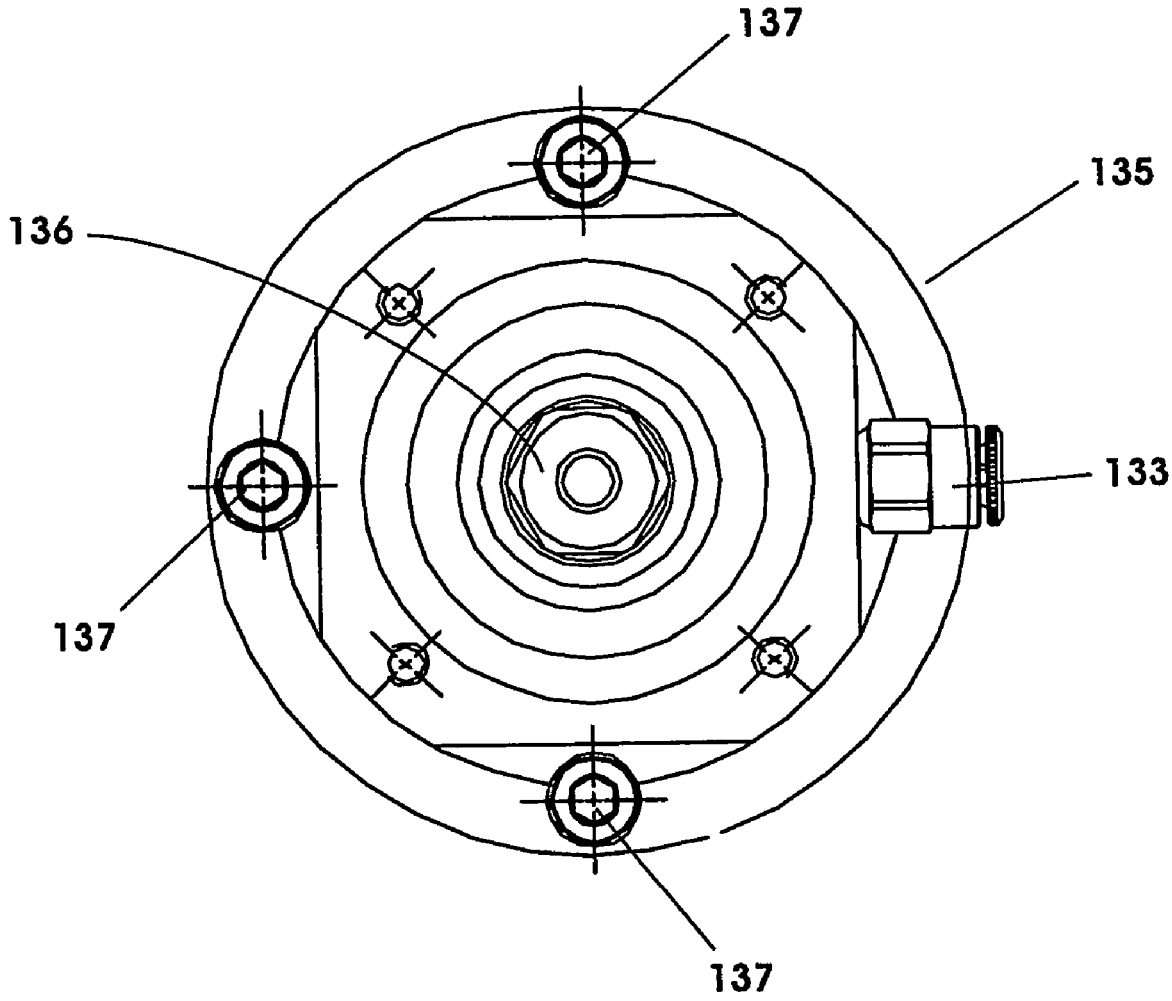
FIG. 20 is a bottom view of the spindle assembly of FIG. 19.

Referring to FIGS. 14 and 15, within the second box section 73 is a rotation motor 82, gear box 83 and gear 84 for providing an orbital rotation to the grinding machine 2. The grinding machine 2 is attached to the second box section 73 by means of a pair of plates 85. Each of the plates 85 is provided with an acruate slot 86. The angle of attachment of the grinding machine 2 relative to the second box section 73 can be adjusted by means of slots 86. By having the grinding machine 2 slightly off vertical, nipple formation on the button being reground is minimized and uneven wear on the grinding cup avoided.

A conduit 87, in the form of an aluminum tube in the embodiment illustrated, at the rear of second box section 73 is used to deliver power, water and/or air feeds to grinding machine 2 without being tangled in the orbital rotation of the grinding machine 2. The remote end 88 of conduit 87 is connected to a flexible conduit 89 that connects to grinding machine 2 through connector 90.

A bit holder tilt control 91 is provided on the side of second box section 73. To set the tilt angle of table 25, the operator presses and holds the button 92 and then sets the angle of tilt using dial knob 93 on the other side of the second box section 73. The angle of tilt will be determined by the angle of the gauge or other buttons on the bit being ground. Display 95 on the operator input panel 94 on the front of the second box section 73 will optionally display 'TILT' for example while button 92 is pressed and held. A second display 95A will indicate the preset angle or the angle selected by turning dial knob 93. Once set, button 92 is released and the tilt angle for table 25 is set. When grinding the gauge buttons, to tilt the table to the preset angle the operator presses button 92. The operator presses button 92B to return the table to the horizontal (ie. a tilt angle of zero).

Operator input panel 94 on the front of the second box section 73 can also be used to set for example button size, grinding time, type of buttons, button wear, percentage of biased side load and feed pressure. The +/− buttons 96 are used to scroll through a menu and dial knob 93 used to select values. The control system may be programmed with preset default values. Start button 97 and stop button 98 are provided on panel 94. Stop button 98 can optionally be used to reach one or more sub-menus. The grinding machine 2 illustrated in the FIGURES utilizes a hex drive system of the type described in U.S. Pat. No. 5,639,273 and U.S. Pat. No. 5,727,994. In order to make the operation of the apparatus operator friendly, means are provided to easily align and attach the grinding cup and detach the grinding cup after use. Pressing spindle 15, brake button 99 will set a brake or lock on the spindle of grinding machine 2 for a short delay period of about 8 seconds to enable the grinding cup to be easily attached. The brake or lock is automatically released at the end of the delay period. Alternately a spring-loaded button can be provided that when depressed will fit into a slot in the rotor and prevent it from rotating. This enables the operator to align the hex drive section of the grinding cup with the drive section of the rotor and then push the grinding cup on. To remove the grinding cup after use the operator presses a lever 100 towards the grinding machine 2. The lever 100 pivots and the extending arms push the grinding cup away from the drive section of the rotor facilitating removal of the grinding cup from the grinding machine. Alternately a powered lever or cylinder can be provided to press against the grinding cup to remove it.

A programmable control card is provided within the second box section 73 optionally attached to rear of operator input panel 94, having a circuit board containing a central processor (ie. microprocessor or microcontroller) for the control system of the grinding apparatus. The control system of the present invention includes systems and controls that together with a microprocessor or microcontroller can control all aspects of the grinding apparatus including grinding time on each button, rotational speed of the grinding cup and grinding pressure. The control system is preferably capable of monitoring and adjusting one or more additional operational parameters selected from the group consisting of coolant flow to the surface of the hard metal insert, coolant flow to the electric motor, output frequency and/or voltage from the frequency inverter, biased side load, counter balancing pressure, bit positioning, power indexing of bits, angle of the grinding machine, speed of the rotation motor, tilting of the table or other support holding the bit, etc. The microprocessor or microcontroller and the control system can be used to provide other functions either manual or automatic. For example, the microprocessor or microcontroller and control system, in the case of an electric motor, can monitor the amperage being used and/or the temperature and if it reaches a preset limit automatically decrease the grinding pressure to prevent motor burn out or turn the motor off. The microprocessor or microcontroller and control system can also control the flow of coolant to the face of the button during grinding.

When grinding buttons the self-centering aspects of the grinding machine tend to center the grinding machine over the highest point on the button. On buttons where wear is uneven, typically gauge buttons, this may result in regrinding the button off center from its vertical axis. One aspect of the present invention provides means to help align the grinding machine with the longitudinal axis of the button to be ground. In the embodiment shown in FIGS. 10 to 12 the means to help align the grinding machine with the longitudinal axis of the button consists of, a cylinder 101 having one end 102 connected to the stand 22 by means of plate 103 and the other end 104 connected to the bottom 105 of the first arm section 59. The cylinder 101 provides a side load to grinding machine 2 to help align the grinding machine 2 with the longitudinal axis of the button. The side load biases the grinding machine 2 to grind more on either the outside or the inside of the gauge buttons as required thereby tending to shift the grinding machine 2 over the true center of the button. The means to help align the grinding machine with the longitudinal axis of the button to be ground can alternatively include a locking system to lock the arm in place to prevent movement in a direction normal to the longitudinal axis of the button while permitting movement in the axial direction. Suitable side load can also be provided by means other than by the cylinder such as counterweights, linear actuator(s), etc. A further aspect of this invention is to effectively control the grinding cup staying on the button utilizing delays and variable strength biased side loads. This safely enhances the self-centering feature to whatever level deemed necessary. A benefit of a softer enhanced "self-centering" principle, as described above, is that it results in less dramatic wear and loads on built-in grinding cup profile resulting in enhanced grinding cup characteristics throughout it's life. Additional benefits include maximized bit life due to unnecessary reduction of outside diameter of bit caused by unnecessary grinding of corresponding areas of the gauge buttons.

To further assist with the alignment of the bits during grinding, laser line indicators 106 are located on the rear 23 of box 24. When activated the laser line indicators provide a beam of light through slots 107 that is aligned with the center axis of apertures 30. When grinding a button, rotation of the bit so the button to be ground is centered on the laser line insures grinding machine 2 will be aligned with the longitudinal axis of the button being ground.

While typical grinding apparatus are aligned so that the longitudinal axis of the bit is generally vertical during grinding, in the case of very large bits, or in drilling equipment where bits or cutters are mounted in a clustered pattern, grinding may be done with the bit aligned horizontally or some other suitable angle. The present invention is equally applicable to this situation. In this situation the grinding machine may be carried on an arm or lever system and the grinding pressure applied in a horizontal or other suitable direction.

Controlled feed forces in the present invention of between preferably 0 to 350 kilos and most preferably about 115 KG, optionally with constant and/or controlled variable biased side-loads, require more power and torque from the grinding head motor than in known grinding apparatus. The present invention preferably utilizes a motor capable of producing substantially higher amounts of torque and/or power than previously used, over a range of rpm's, with a relatively compact size and weight. To further optimize the power and/or torque to size ratio, and to add the flexibility to change the motor performance characteristics as deemed appropriate the present invention preferably utilizes a frequency inverter. In the embodiment shown in FIG. 10, the frequency inverter 108 is installed within the first arm section 59. A frequency inverter allows for the base frequency (i.e. typically 50 or 60 Hz) and/or voltage to be varied up or down to enable optimized power and torque to be drawn from a relatively compact motor. The use of frequency inverters allow for substantially changing the motor size to power ratio (i.e. relatively small motors produce more mean power across the range of suitable RPMs). Also, the RPM can be varied by changing the set frequency and/or voltage. A frequency inverter can also be used as a single phase to three phase power converter.

Until the compact solid-state frequency inverter (a.k.a. High Frequency Drives), the only way to change the frequency of standard 50 or 60 Hz power supplies was through bulky often fixed frequency electromechanical means, often also utilizing maintenance intensive brush type technology. Motors are designed to produce a certain amount of power and RPM at a given frequency (hence same motor will have different RPMs at 50 and 60 Hz). Changing the frequency allows the present invention to change the RPMs while in many cases maintaining the power. Maintaining power output often applies to both increasing and/or decreasing the motor RPM of many motors above or below its rated frequency/RPM.

Figure 12:
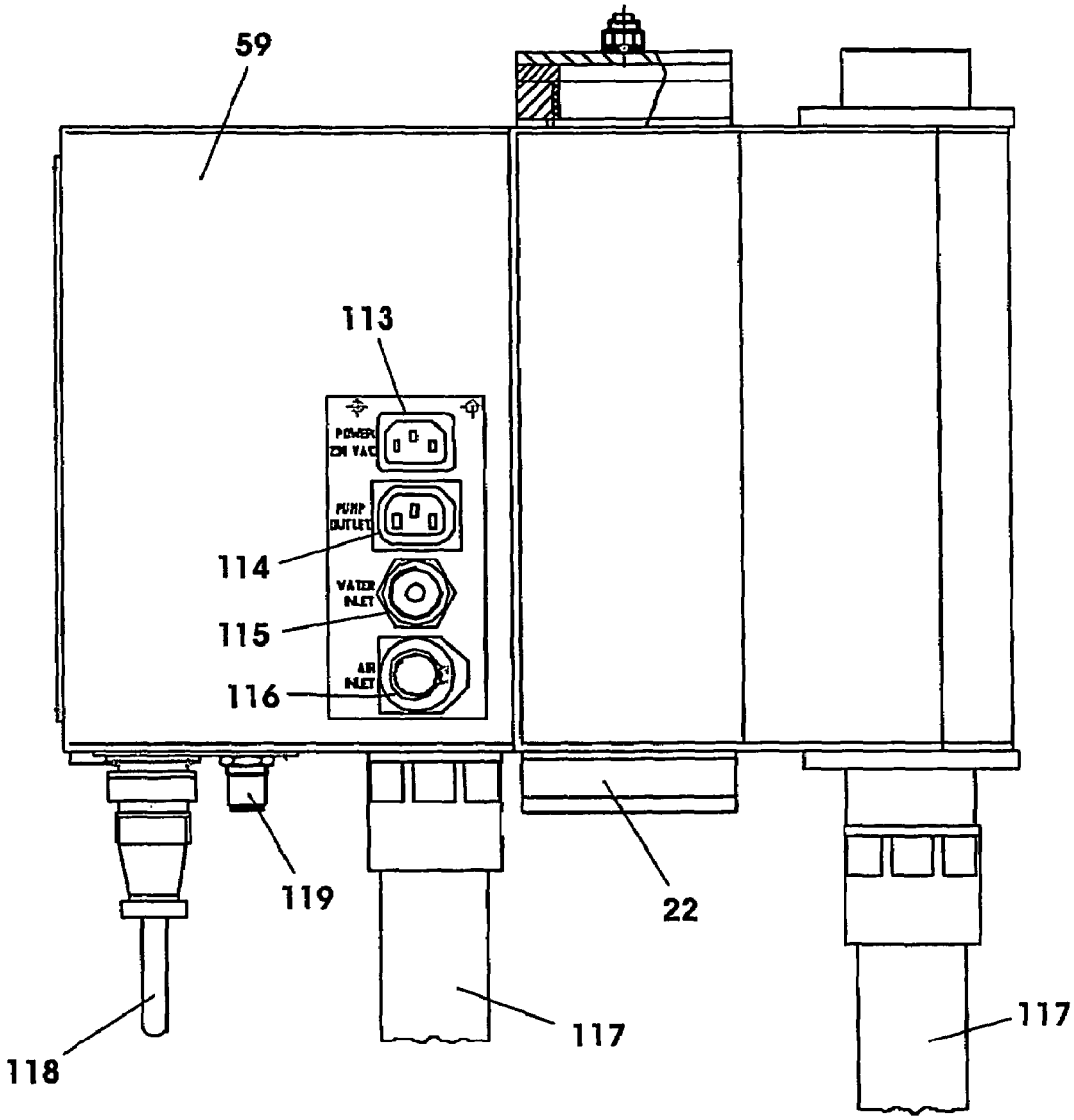
FIG. 12 is a left side view of the first arm section of FIGS. 10 and 11.
Figure 13:
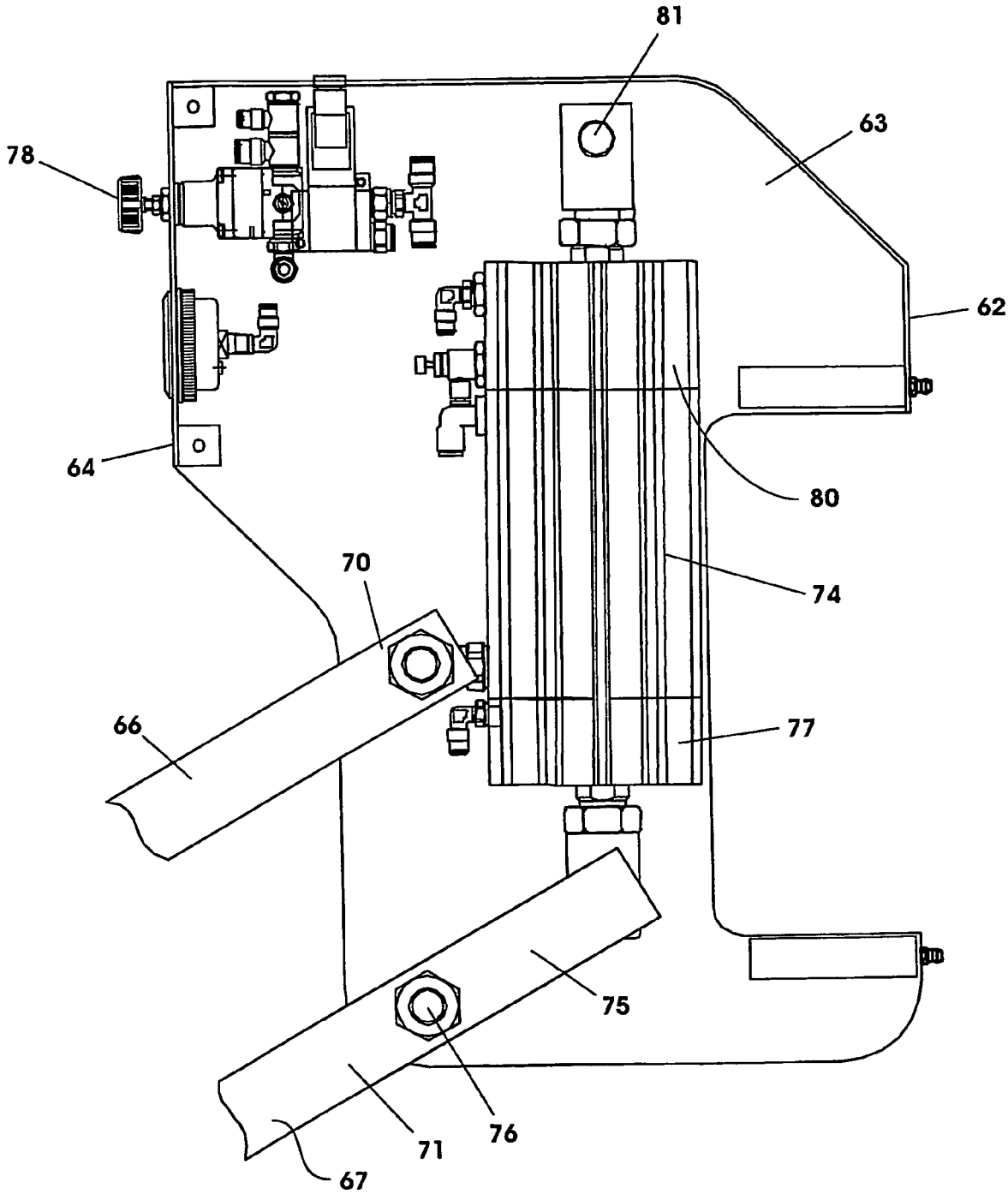
FIG. 13 is an internal side view of the first box section and second arm section of the support system of FIG. 1.

Using a frequency inverter allows the present invention to utilize a relatively compact motor and produce similar power across a range of RPMs. One function of the overall control system is to monitor and control the frequency inverter 108. Like most other functions on the grinding apparatus, the frequency inverter 108 receives its instructions from the microprocessor or microcontroller on the circuit board (programmable control card module) behind the operator input panel 94, through input/output (I/O) card 109. Although the microprocessor or microcontroller in the programmable control card module is the brain, the I/O card module acts as a central communications hub in the overall control system, linking the various systems and modules together. Air vents 110, 111 are provided in the first arm section 59. An electrical noise filter 112 is provided to filter electrical noise in the power supply produced by the frequency inverter. As shown in FIG. 12, on the side of the first arm section 59 a power input plug 113, power output plug 114 for a water pump (not shown), water inlet valve 115 and compressed air inlet valve 116 are provided. Conduit 117 permits the power, water and air lines to go from the first arm section 59 to the first box section 64. Power and air lines 118, 119 go from the first arm section 59 to the controls for the tilting of table 25 and control of the locking cylinders 34 in apertures 30. Auxiliary air and power connections 120, 121 are provided at the front of the control housing on the side 28 of box 24. Legs 122 and feet 123 permit box 24 to be leveled.

At higher feed or grinding pressure, lower grinding cup rpm's (preferably 2200 to 6000 RPM vs 12,000 to 22,000 RPM in conventional grinders) has been shown to produce a much more stable and productive environment in which the abrasive (diamond matrix) on the grinding surface of the grinding cup can operate. The result is improved cutting performance, substantially improved cutting point regeneration, and improved grinding cup profile retention. In other words the abrasive is able to perform at its peak performance. In addition, the present invention has determined that variable RPM may be necessary to optimize grinding performance and economy for any given feed and/or carbide button size. Smaller buttons appear to require less feed than larger ones. Smaller buttons may also require somewhat higher RPM than larger ones. Either one or a combination of both variable RPM and feed may also be necessary during grinding of any one button for the purpose of initial heavy material removal rates followed by final surface finishing.

Certain known grinding apparatus, that use a gearbox principle tying orbital rotation of the grinding machine to spindle or grinding cup RPM, do not allow separate controls of orbital rotation speed and grinding head speed. Excessive orbital rotation speed has been shown to be a substantial source of instability during the grinding process. While the RPMs of devices using the gearbox principle can be increased or decreased by using a frequency inverter for example to control the output speed of the drive motor, the relatively high orbital rotation speed would result in a harsh and unstable process. The gear ratio used in this type of known grinding machines is approximately 1:3 (ie. 1 orbital rotation results in 3 output spindle rotation). The present invention optimizes stability and overall optimization of system performance by not tying orbital rotation of the grinding machine to spindle or grinding cup RPM.

Air-cooled electric motors are currently used in various button bit and/or cutter grinders. Traditionally air-cooled electric motors with sufficient torque and power for the present invention utilizing high feeds are substantially larger than what is feasible for mounting as a grinding head motor on an articulating arm of any type without making the unit too cumbersome.

Thermal management of air-cooled motors is heavily dependent on the fans capability to force air over the motor, thus cooling it. As the fan speed is lowered, so is its ability to produce sufficient air flow to sufficiently dissipate heat. In addition, the efficiency of the heat exchange taking place is heavily dependent on the ambient temperature. As the ambient temperature increases, the cooling ability of the air is decreased.

The solution to these problems provided by the present invention has been the development of a water-cooled electric motor that can optionally use the same coolant that is used during grinding by the grinding cup. Since liquid cooling is much more efficient in its ability to dissipate heat, the temperature of the water is not nearly as critical as the temperature of the ambient air in an air-cooled motor. Use of a water-cooled motor allows the grinding apparatus of the present invention to grind over a wide RPM range with no dependency on fans to cool the motor, while drawing substantially higher power and torque. There have been problems reported using air-cooled motors (both electric and hydraulic) in hot place (i.e. desserts, etc.) due specifically to the high ambient temperatures and the challenges associated with that. Water-cooling solves most if not all of these problems.

The preferred embodiment of a water-cooled electric motor for grinding machine 2 is shown in FIGS. 15 to 20. FIG. 15 shows the grinding machine 2 attached to plates 85 below the second box section 73. The grinding machine 2 is locked in place by levers 124. The water-cooled electric motor, generally indicated at 125, has an exterior housing 126 defining a chamber 127 in which the rotor 128 and stator 129 are located. Within the wall of the housing 126 are located a series of longitudinal channels 130 for the cooling water. Ports 131, 132 permit water in and water out respectively. A drive coupling 133 at the bottom 134 of housing 126 permits attachment of the spindle assembly 135. The drive coupling 133 is inserted into the mating drive coupling 140 on spindle assembly 135. The spindle assembly 135 has an output drive shaft 136 to which a grinding cup can be connected. The spindle assembly 135 is attached to the electric motor housing 126 by bolts 137. Coolant water for delivery to the grinding cup surface is provided though connection 138. The electric motor 125 is preferably a three-phase motor and power is connected through connection 90 to connection box 139. A flexible splash cup 141 is placed around the output drive shaft 136 of spindle assembly 135. Use of a water cooled motor provides additional advantages. Because the motor housing is sealed entry of dirt and other contaminants into the housing is minimized. In addition without a fan as in air cooled motors the motor runs substantially quieter.

To control all of the above functions the grinding apparatus is provided with a control system having an operator input panel 94 directly connected to an electronic programmable control card module capable of issuing the necessary commands to, for example, the I/O card module 109 etc. is preferably used. The control system utilizes a circuit board (programmable control card module) behind the operator input panel 94 on the second box section 73 for input and processing of operator input. The programmable control card module and its circuit board is in communication with the I/O card module 109 which connects to all main systems, of which two key areas preferably include frequency inverter function and tilt/laser control card module 51 that monitors and controls the tilting of table 25 and the frequency output and/or voltage of frequency inverter 108. Such a control system can be used to continuously monitor all or select operational parameters, and if deemed necessary, for example continuously adjust the feed pressure if the motor current (i.e. Amps) rises above a set maximum, increase coolant flow if motor temp gets too high, etc. Utilizing software, microprocessor or microcontroller controlled grinding can influence the grinder behaviour characteristics. The software can in addition to providing operational parameters also deal with laser controlled shut off, sleep mode for the apparatus, error reporting, service reminders, forced replacement of worn parts, components, or modules as deemed necessary for proper operation or to control access for maximized performance. It can also be used to substantially modify grinder behaviour by a simple re-programming or replacement of the microchip, microcontroller or processor. It could be made possible for the operator to update the programming or replacement of chip (and thus the grinders behaviour) right on site which ensures maximum grinder availability to the user. This would allow flexibility in terms of future grinder upgrades. For example, a new grinding cup with a new matrix formulation may require the grinder to behave differently. By simply changing the software program used by the grinder, the behaviour characteristics and any other key variables can be adjusted as required. This would ensure that user would receive customized/optimized performance from the grinder. While the location of the control system components has been illustrated in the preferred embodiment the present invention is not restricted to the location and arrangement of the control system components.

In addition, the control panel software can be configured such that the user could select for example whether long grinding cup life or high material removal rate of the grinding cup is preferred.

The present invention also preferably utilizes a "soft start" where grinding/feed pressure and grinding cup RPM are increased progressively either continuously or in steps to enhance the self-centering feature to whatever level deemed necessary. A benefit of a softer enhanced "self-centering" principle, as described above, is that it results in less dramatic wear and loads on built-in grinding cup profile resulting in enhanced grinding cup characteristics throughout it's life.

Once the grinder is properly connected to the power source, compressed air source, and water source, the grinding apparatus is ready to grind. An initial operating sequence for a new set of bits, starting off by grinding the face buttons, with bit holder in down (horizontal) position could for example be as follows: a) load bit(s) into bit holder and secure using locking cylinders in bit holder or appropriate bit holder accessories b) determine size and profile of buttons on bit(s) to be ground c) lock the output spindle of the grinding apparatus by pressing the spindle break button on the operator input panel followed by inserting the correct size and profile of grinding cup into chuck of the grinder while the spindle break is active d) Input estimated grinding time into primary menu on the operator control panel using adjusting knob e) Scroll to next menu on the operator input panel and select button size and optionally profile, etc using the adjusting knob f) Scroll to additional menus if necessary to input any other relevant data such as bias side load settings, button wear, etc using control knob when needed for each menu g) Place the grinder with grinding cup on top of button to be sharpened h) Press start and monitor the grinder to ensure proper function.

Grinding gauge buttons would be performed in the same manner as above after the following steps: a) angle of the gauge buttons is set by pressing and holding down the bit holder tilt up button while turning the adjusting knob until desired angle is displayed on the operator input panel b) release the bit holder tilt up button and the bit holder will tilt to the selected preset angle.

Variations of the above described principles including increased feeds/grinding pressure, lower grinding cup RPM, water cooled motor, using frequency inverters, biased side loads, counter balancing and position fixing, that can be used to allow for grinding at angles other than vertical, are within the scope of the present invention. Combinations of variations of the above described principle of increased feeds/grinding pressure, lower grinding cup RPM, water cooled motor, using frequency inverters biased side loads, counter balancing and position fixing can be used to substantially eliminate the need for tilting/pivoting the bit when switching between grinding of face buttons and gauge buttons. Some of the above principles could also be applied to for example pneumatically and/or hydraulically powered motors. In addition on existing air-cooled motors, spindle speed can be varied using a gear box arrangement between the motor output and the spindle drive input to reduce spindle RPM, optionally variable, up to 45% or more.

Having illustrated and described a preferred embodiment of the invention and certain possible modifications thereto, it should be apparent to those of ordinary skill in the art that the invention permits of further modification in arrangement and detail and is not restricted to the specific semi-automatic grinding apparatus illustrated.

It will be appreciated that the above description related to the preferred embodiment by way of example only. Many variations on the invention will be obvious to those knowledgeable in the field, and such obvious variations are within the scope of the invention as described and claimed, whether or not expressly described.

The embodiments of the invention in which an exclusive property or privilege is claimed are defined as follows:

1. A grinding apparatus for grinding working tips of hard metal inserts of rock drill bits, comprising:

a grinding machine, means for holding a rock drill bit to be ground and a support system, the support system having means for providing a controlled variable feed pressure during grinding, the grinding machine equipped with a spindle assembly having an output drive shaft having a longitudinal axis, one of a plurality of grinding tools of different sizes and profiles detachably connected to the output drive shaft for grinding different sizes and profiles of working tips, and means for varying and controlling feed pressure and a speed of rotation of the output drive shaft during grinding based on a size of a connected grinding tool.

2. The grinding apparatus according to claim 1 wherein the grinding machine has an electric motor.

3. The grinding apparatus according to claim 2 wherein a frequency inverter is provided between the electric motor and an electric power source to vary the rotational speed of the output drive shaft.

4. The grinding apparatus according to claim 2 wherein the electric motor is water-cooled.

5. The grinding apparatus according to claim 1 wherein the grinding tool is a grinding cup.

6. The grinding apparatus according to claim 1 wherein a rotation motor and bearing arrangement are provided on the support system of the grinding apparatus for providing an orbital rotation to the grinding machine around a longitudinal axis of the hard metal inserts.

7. The grinding apparatus according to claim 3 wherein the frequency inverter is a compact solid-state frequency inverter.

8. The grinding apparatus according to claim 3 wherein the frequency inverter is a spindle brake to enable the grinding tool to be aligned and attached to the output drive shaft.

9. The grinding apparatus according to claim 1 wherein the grinding apparatus has a self-centering grinding machine and the support system permits movement of the grinding machine horizontally and vertically.

10. The grinding apparatus according to claim 9, wherein the support system has means for providing a balance pressure when the grinding machine is not in use and means for providing the feed pressure when in use.

11. The grinding apparatus according to claim 10, wherein the means for providing a balance pressure and the means for providing the feed pressure are adapted to produce the balance pressure and the feed pressure independently.

12. The grinding apparatus according to claim 11 wherein the means for providing the feed pressure limits a maximum movement of the grinding tool.

13. The grinding apparatus according to claim 12 wherein the grinding apparatus has a separate short stroke cylinder.

14. The grinding apparatus according to claim 11 wherein the means for providing the feed pressure is one or more linear actuators, gears assemblies, pulley systems, counterweights or any combination thereof.

15. The grinding apparatus according to claim 1 wherein the grinding apparatus further has a control system that has a series of interconnected control modules having an operator input panel and a programmable control card module, the control system is adapted to monitor and to automatically adjust one or more operational parameters selected from a group consisting of the feed pressure and the rotational speed of the output drive shaft and a grinding time.

16. The grinding apparatus according to claim 15 wherein the series of interconnected control modules are connected to a multi-function input/output card module that acts as a central communications hub for all the interconnected control modules.

17. The grinding apparatus according to claim 15 wherein the interconnected control modules have one or more programmable microprocessors, microcontrollers or a combination thereof.

18. The grinding apparatus according to claim 17 wherein one or more programmable microprocessors, microcontrollers are replaceable to facilitate modification of a software integral to a functionality of the interconnected control modules.

19. The grinding apparatus according to claim 1 wherein the grinding machine has a pneumatically or hydraulically powered motor.

20. The grinding apparatus according to claim 19 wherein the grinding apparatus has a control system that has a series of interconnected control modules that have an operator input panel and a programmable control card module.

21. A method of grinding working tips of hard metal inserts of rock drill bits, comprising:

providing a grinding apparatus having a grinding machine equipped with an output drive having a longitudinal axis and means to detachably retain one of a plurality of grinding tools for grinding different sizes and profiles of working tips, speed control means for controlling and varying the speed of rotation of the output drive, and a support system, pressure control means on the support system for controlling and varying feed pressure during grinding and means for holding a rock drill bit to be ground;

inserting the rock drill bit into the means for holding the rock drill bit to be ground, determining the size and profile of one or more working tips of the same size and profile, and attaching a grinding tool to the grinding machine corresponding to the size and profile of the one or more working tips, selecting a first rotational speed of the output drive and a first feed pressure, aligning the grinding tool about the longitudinal axis of said one or more working tips to be ground, grinding said one or more working tips at the first rotational speed and the first feed pressure;

determining the size and profile of one or more other working tips on the same or a different rock drill bit of a second same size and profile, and attaching a grinding tool to the grinding machine corresponding to the size and profile of the one or more other working tips, selecting a second rotational speed of the output drive and a second feed pressure, aligning the grinding tool about the longitudinal axis of said one or more other working tips to be ground grinding said one or more other working tips at the second rotational speed and the second feed pressure.

22. The method according to claim 21 wherein the method further comprises the step of reducing the first rotational speed to the second rotational speed when the second size is greater than the first size.

23. The method according to claim 21 wherein the method further comprises the step of increasing the first feed pressure to the second pressure when the second size is greater than the first size.

24. The method according to claim 21 wherein the method further comprises the step of increasing the second pressure to between 115-350 kilograms.

25. The method according to claim 21 wherein the method further comprises the step of reducing the second rotational speed to between 2200-6000 revolutions per minute.

26. The method according to claim 21 wherein the method further comprises varying the rotational speed and the feed pressure during a grinding cycle of a working tip on a rock drill bit.

27. The method according to claim 21 wherein the method further comprises applying the feed pressure along a longitudinal axis of a working tip on a rock drill bit.

28. The method according to claim 21 wherein the method further comprises rotating the output drive shaft at variable speeds from about 1,000 to 11,000 revolutions per minute and providing a variable feed pressure up to 350 kilograms.

29. The method according to claim 21 wherein the method further comprises varying the rotational speed for different sizes and profiles of working tips on a rock drill bit.

30. The method according to claim 21 wherein the method further comprises ramping up the rotational speed to a desired rotational speed for a particular size and profile of a working tip to be ground and thereafter holding a constant rotational speed for a duration of a grinding cycle for a working tip on a rock drill bit.

31. The method according to claim 30 wherein the method further comprises ramping up the rotational speed progressively or in steps to enhance one or more of self-centering, grinding tool cutting performance, grinding tool longevity and grinding tool profile integrity.

32. The method according to claim 21 wherein the method further comprises ramping up the feed pressure to a desired level for a particular size and profile of a working tip to be ground and thereafter holding the feed pressure constant for the duration of the grinding cycle for the working tip.

33. The method according to claim 32 wherein the method further comprises ramping up the feed pressure progressively or in steps to enhance one or more of self-centering, grinding tool cutting performance, grinding tool longevity and grinding tool profile integrity.

34. The method according to claim 21 wherein the method further comprises varying the rotational speed and varying the feed pressure independently during a grinding cycle of a working tip on a rock drill bit.

35. The method according to claim 29 wherein the method further comprises providing a coolant to a surface of working tips of hard metal inserts during grinding as a flushing medium.

36. The method according to claim 21 wherein the method further comprises using a frequency inverter to vary voltage and frequency to act as a variable electrical power source to optimize power and torque of an electrical motor at any given revolutions per minute.

37. The method according to claim 21 wherein the method further comprises automatically activating a cylinder and providing a biased side load when a table, holding the drill bit to be ground, is tilted.

38. The method according to claim 21 wherein the method further comprises aligning the grinding machine with working tips of hard metal inserts laser line indicators.

39. The method according to claim 21 wherein the method further comprises providing an operator input panel and inputting a size and a profile of the a working tip of a hard metal insert to be ground to a programmable control card module and wherein a control system automatically sets, monitors and adjusts operational parameters selected from a group consisting of the feed pressure, rotational speed and grinding time.

40. The method according to claim 21 wherein the method further comprises providing a control system to progressively increases the feed pressure and rotational speed of a grinding cup on start up.

41. The method according to claim 21 wherein the method further comprises providing a control system that monitors operating characteristics of an electric motor of the grinding machine and utilizes a frequency inverter to vary voltage and frequency to the electric motor to optimize power and torque for a given revolutions per minute.

42. The method according to claim 21 wherein the method further comprises providing a microprocessor and a microcontroller or programmable control card module that are capable of monitoring and automatically adjusting one or more additional operational parameters within a system function selected from a group consisting of coolant flow to a surface of a hard metal insert, coolant flow to an electric motor, output voltage and/or frequency from a frequency inverter to the electric motor, current draw of the electric motor, biased side load, feed and/or counter balancing pressure, bit positioning, angle of the grinding machine, speed of an orbital rotation motor, speed of a grinder head motor, speed of the output drive shaft or tilting of a table or other support holding the drill bit.

43. The method according to claim 21 wherein the method further comprises using an overall control system and an frequency inverter to automatically control a maximum current drawn by an electric motor during operation in order to protect against overloading and damage to the electric motor.

44. The method according to claim 21 wherein the method further comprises providing a programmable control card module that is capable of providing error reporting, service reminders, forced replacement of worn parts, components or modules or access control.

* * * * *